US011809114B2

(12) United States Patent
Inoue

(10) Patent No.: US 11,809,114 B2
(45) **Date of Patent: *Nov. 7, 2023**

(54) IMAGE FORMING APPARATUS

(71) Applicant: CANON KABUSHIKI KAISHA, Tokyo (JP)

(72) Inventor: Hiroshige Inoue, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/882,997

(22) Filed: Aug. 8, 2022

(65) Prior Publication Data

US 2023/0068809 A1 Mar. 2, 2023

(30) Foreign Application Priority Data

Sep. 2, 2021 (JP) ..... 2021-143319

(51) Int. Cl.
*G03G 15/00* (2006.01)

(52) U.S. Cl.
CPC ..... *G03G 15/5029* (2013.01); *G03G 15/5016* (2013.01); *G03G 2215/00126* (2013.01); *G03G 2215/00734* (2013.01); *G03G 2215/00738* (2013.01)

(58) Field of Classification Search
CPC ..... G03G 15/6502–6514; G03G 2215/00734; G03G 2215/00721
See application file for complete search history.

(56) References Cited

U.S. PATENT DOCUMENTS 8,032,041 B2 10/2011 Atsumi et al.
8,179,541 B2 5/2012 Nakazawa
8,577,278 B2 * 11/2013 Inoue ..... G03G 15/0131 399/394
9,581,928 B2 * 2/2017 Deno ..... G03G 15/043
10,474,078 B2 * 11/2019 Hayakawa ..... H04N 1/00702

FOREIGN PATENT DOCUMENTS

JP 2008083665 A 4/2008
JP 2009186848 A 8/2009

* cited by examiner

*Primary Examiner* — Leon W Rhodes, Jr.
(74) *Attorney, Agent, or Firm* — ROSSI, KIMMS & McDOWELL LLP

(57) ABSTRACT

An image forming apparatus includes a sheet stacking portion, an image forming portion, a detection portion configured to detect a position, in a sheet width direction, a storage configured to store position information of a sheet, and a controller. The controller is configured to cause the storage to store the position information based on a position of a sheet detected by the detection portion during execution of the job, and if sheet information of a sheet used in a previous job is matches sheet information of a sheet used in a current job, cause the image forming portion to start formation of an image to be formed on a first sheet, before a position of the first sheet is detected by the detection portion, based on the position information stored in the storage in the previous job.

13 Claims, 9 Drawing Sheets

| | FIRST OR SECOND SHEET | | THIRD AND FOLLOWING SHEETS | RETRIAL |
|---|---|---|---|---|
| | SAME SHEET INFORMATION AS THAT IN PREVIOUS JOB | DIFFERENT SHEET INFORMATION FROM THAT IN PREVIOUS JOB | | |
| HIGH-PRODUCTIVITY MODE | AVERAGE VALUE Δav OF LATERAL-REGISTRATION POSITIONS USED IN PREVIOUS JOB | LATERAL-REGISTRATION POSITION Δ(0) CORRESPONDING TO SHEET INFORMATION IN CURRENT JOB | AVERAGE VALUE Δav OF LATERAL-REGISTRATION POSITIONS OBTAINED IN CURRENT JOB | NON-EXECUTABLE |
| BALANCE MODE | AVERAGE VALUE Δav OF LATERAL-REGISTRATION POSITIONS USED IN PREVIOUS JOB | LATERAL-REGISTRATION POSITION Δ(0) CORRESPONDING TO SHEET INFORMATION IN CURRENT JOB | AVERAGE VALUE Δav OF LATERAL-REGISTRATION POSITIONS OBTAINED IN CURRENT JOB | EXECUTABLE |
| HIGH-ACCURACY MODE | LATERAL-REGISTRATION POSITION Δ(n) OF SHEET DETECTED BY LATERAL-REGISTRATION DETECTION SENSOR | | | NON-EXECUTABLE |

FIG.8

| | FIRST OR SECOND SHEET | | THIRD AND FOLLOWING SHEETS | RETRIAL |
|---|---|---|---|---|
| | SAME SHEET INFORMATION AS THAT IN PREVIOUS JOB | DIFFERENT SHEET INFORMATION FROM THAT IN PREVIOUS JOB | | |
| HIGH-PRODUCTIVITY MODE | AVERAGE VALUE Δav OF LATERAL-REGISTRATION POSITIONS USED IN PREVIOUS JOB | LATERAL-REGISTRATION POSITION Δ(0) CORRESPONDING TO SHEET INFORMATION IN CURRENT JOB | AVERAGE VALUE Δav OF LATERAL-REGISTRATION POSITIONS OBTAINED IN CURRENT JOB | NON-EXECUTABLE |
| BALANCE MODE | AVERAGE VALUE Δav OF LATERAL-REGISTRATION POSITIONS USED IN PREVIOUS JOB | LATERAL-REGISTRATION POSITION Δ(0) CORRESPONDING TO SHEET INFORMATION IN CURRENT JOB | AVERAGE VALUE Δav OF LATERAL-REGISTRATION POSITIONS OBTAINED IN CURRENT JOB | EXECUTABLE |
| HIGH-ACCURACY MODE | LATERAL-REGISTRATION POSITION Δ(n) OF SHEET DETECTED BY LATERAL-REGISTRATION DETECTION SENSOR | | | NON-EXECUTABLE |

(HIGH-PRODUCTIVITY MODE)

(BALANCE MODE)

(HIGH-ACCURACY MODE)

IMAGE FORMING APPARATUS

BACKGROUND OF THE INVENTION

Field of the Invention

The present invention relates to an image forming apparatus that forms images on sheets.

Description of the Related Art

Image forming apparatuses, such as printers, copying machines, multifunction printers, and business printers, are required to form an image on a sheet with high positional accuracy of image with respect to the sheet. For increasing the positional accuracy of image in a sheet width direction (i.e., a main scanning direction in image formation), the image position is corrected by using a detection result from a sensor that detects a sheet position in the sheet width direction. Japanese Patent Application Publication No. 2008-083665 describes an image forming apparatus that forms images, while correcting image positions, when performing continuous printing on a plurality of sheets. Specifically, when performing the continuous printing on a predetermined number of sheets starting from the first sheet, the image forming apparatus corrects an image position with respect to a current sheet, based on the position of the current sheet detected by a sensor; and forms the image. In addition, when performing the continuous printing on other sheets following the predetermined number of sheets, the image forming apparatus corrects an image position with respect to a current sheet, based on an average value of positions of the predetermined number of sheets detected by the sensor; and forms the image.

Japanese Patent Application Publication No. 2009-186848 describes another image forming apparatus that forms images, while correcting image positions, when performing continuous printing on a plurality of sheets. Specifically, when performing the continuous printing on the first sheet, the image forming apparatus corrects an image position with respect to the first sheet, based on the position of the first sheet detected by a sensor; and forms the image. In addition, when performing the continuous printing on the second and the following sheets, the image forming apparatus corrects an image position with respect to a current sheet, based on an average value of positions of the first to the previous sheets (the previous sheet is a sheet immediately preceding the current sheet; and forms the image. If the difference between the position of a current sheet detected by a sensor and the above-described average value exceeds a threshold, the image forming apparatus stops the image forming process, which has already been started; corrects the image position with respect to the current sheet, based on the position of the current sheet; and forms the image again.

However, the image forming apparatuses described in Japanese Patent Application Publication Nos. 2008-083665 and 2009-186848 start the formation of an image to be formed on the first sheet, after the sensor detects the position of the first sheet. Thus, the first print out time (FPOT) from when an image forming job is started, until the first resulting object is outputted, is longer than the FPOT of a configuration that starts the formation of an image to be formed on the first sheet, before the sensor detects the position of the first sheet. For this reason, it has been desired to shorten the FPOT while suppressing the deterioration of positional accuracy of image.

SUMMARY OF THE INVENTION

The present invention provides an image forming apparatus that can shorten FPOT while achieving high positional accuracy of image.

According to one aspect of the invention, an image forming apparatus includes a sheet stacking portion on which a sheet is stacked, an image forming portion configured to form an image on a sheet fed from the sheet stacking portion, a detection portion configured to detect a position, in a sheet width direction orthogonal to a sheet conveyance direction, of a sheet being fed from the sheet stacking portion to the image forming portion, a storage configured to store position information of a sheet in the sheet width direction, and a controller configured to control a job in which a sheet is fed from the sheet stacking portion and the image forming portion forms an image on the sheet, wherein the controller is configured to cause the storage to store the position information based on a position of a sheet detected by the detection portion during execution of the job, and if sheet information of a sheet used in a previous job is matches sheet information of a sheet used in a current job, cause the image forming portion to start formation of an image to be formed on a first sheet, before a position of the first sheet is detected by the detection portion, based on the position information stored in the storage in the previous job.

Further features of the present invention will become apparent from the following description of exemplary embodiments with reference to the attached drawings.

BRIEF DESCRIPTION OF THE DRAWINGS

FIG. 8 is a decision table of lateral-registration position information of an embodiment.

DESCRIPTION OF THE EMBODIMENTS

Hereinafter, an embodiment of the present disclosure will be described with reference to the accompanying drawings.

Image Forming Apparatus

Figure 1:
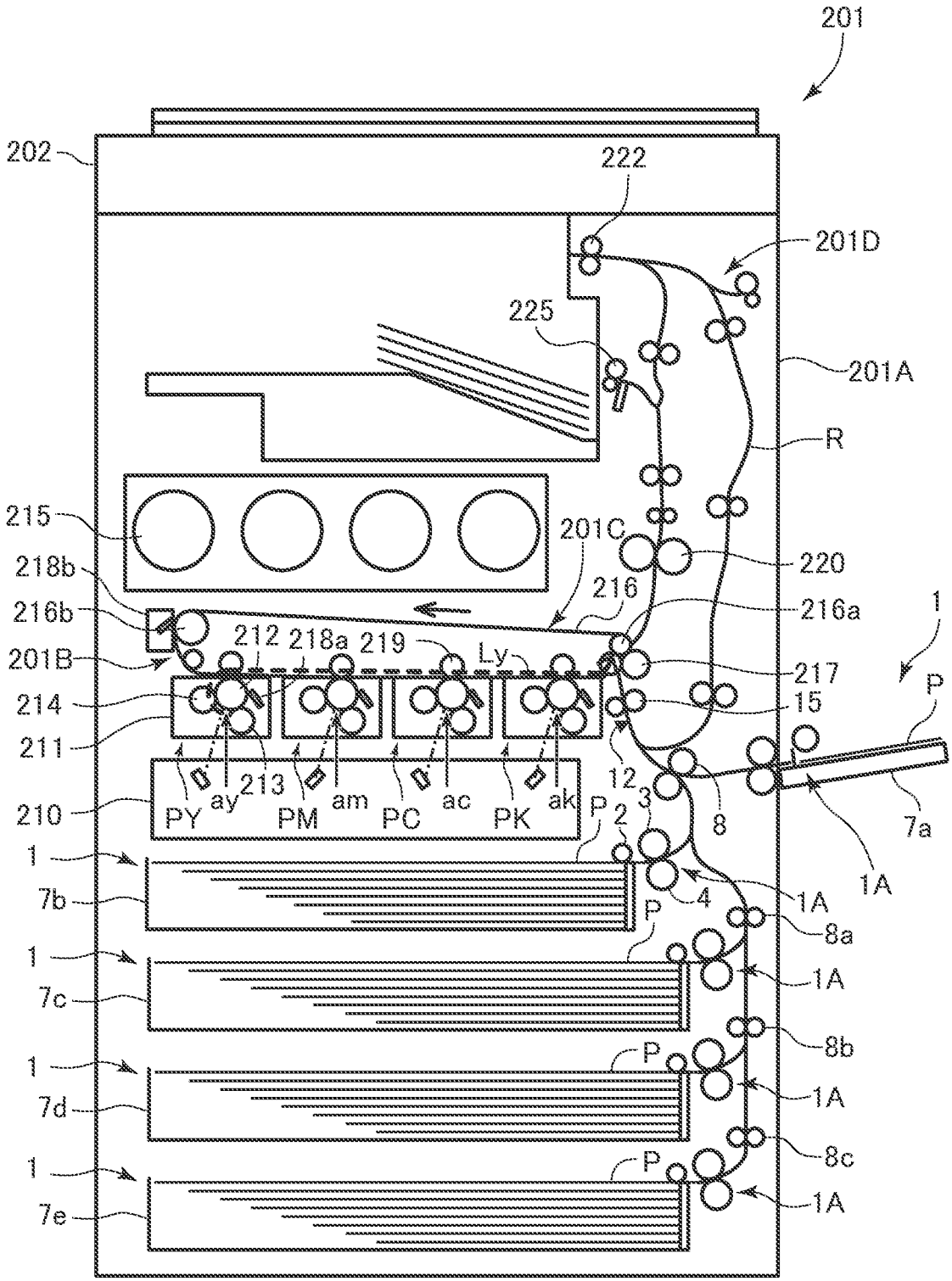
FIG. 1 is a schematic diagram of an image forming apparatus of an embodiment.

FIG. 1 is a schematic diagram illustrating a cross section of an image forming apparatus 201 of an embodiment. An image forming apparatus body 201A (hereinafter, referred to as an apparatus body) of the image forming apparatus 201 includes an image forming portion 201B that forms an image on a sheet, and a fixing portion 220 that fixes the image to the sheet. Above the apparatus body 201A, an image reading apparatus 202 is disposed substantially horizontally. In addition, a discharging space portion is formed between the image reading apparatus 202 and the apparatus body 201A for discharging sheets.

In a lower portion and a side portion of the apparatus body 201A, a plurality of sheet feeding apparatuses 1 are disposed. A sheet P that serves as a recording medium may be of a variety of sheets having different materials and sizes. For example, the sheet P may be a paper sheet such as a plain paper sheet or a thick paper sheet, a specialized paper sheet such as a coated paper sheet, a plastic film used for overhead projectors, a cloth sheet, or an envelope. The sheet feeding apparatuses 1 include feeding trays 7*a*, 7*b*, 7*c*, 7*d*, and 7*e* that serve as sheet stacking portions on which the sheet P is stacked, and feeding units 1A that feed the sheet P, one by one, from the feeding trays 7*a*, 7*b*, 7*c*, 7*d*, and 7*e*. In the example illustrated in FIG. 1, the feeding tray 7*a* is a manual feed tray or a multipurpose tray, which is disposed in a side portion of the apparatus body 201A so as to be able to be opened and closed. The feeding trays 7*b* to 7*e* are cassettes disposed in a lower portion of the apparatus body 201A and forming layers in the vertical direction. Each of the feeding trays 7*b* to 7*e* can be drawn out of the apparatus body 201A.

Each of the feeding units 1A is a unit having a roller system, and includes a pickup roller 2 and a separation roller pair. The pickup roller 2 feeds an uppermost sheet of the sheets P stacked on a corresponding one of the feeding trays 7*a* to 7*e*; and the separation roller pair conveys the sheet P, one by one, while separating one from the other. The separation roller pair includes a feed roller 3 that conveys the sheet P, and a retard roller 4 that is in pressure contact with the feed roller 3. The separation roller pair conveys the sheet P in a nip portion (separation nip) while separating the sheet P from the other by friction. The configuration of the feeding units is not limited to this. For example, the separation member may be a roller member that is supported by a fixed shaft via a torque limiter, or may be a pad-like elastic member that is in pressure contact with the feed roller 3. The feeding units 1A may have another feeding mechanism. For example, the feeding units 1A may have a belt system. In this system, air is drawn toward the inside of an endless belt member that has air-permeability, so that the sheet P is conveyed while sticking to the endless belt member.

The image forming portion 201B disposed as an image forming portion is a four-drum full-color electrophotographic unit. That is, the image forming portion 201B includes a laser scanner 210 that serves as an exposing unit, and four process cartridges PY, PM, PC, and PK that respectively form four-color toner images of yellow, magenta, cyan, and black. The process cartridges PY to PK have substantially the same configuration, except for the color of toner that serves as the developer used for developing. Each of the process cartridges PY to PK includes a photosensitive drum 212 that serves as an image bearing member, a charger 213 that serves as a charging unit, a development unit 214 that serves as a developing unit, and a drum cleaner 218*a* that serves as a cleaning unit. The photosensitive drum 212 is a photoreceptor in electrophotography, which is formed like a drum. The image forming portion 201B further includes an intermediate transfer unit 201C, which is disposed above the process cartridges PY to PK. Above the intermediate transfer unit 201C, a toner cartridge 215 is attached to the apparatus body 201A for supplying the toner to the development unit 214.

The intermediate transfer unit 201C is a transfer unit that transfers a toner image formed on the photosensitive member, onto the sheet P. In the present embodiment, the intermediate transfer unit 201C has an intermediate transfer system. The intermediate transfer unit 201C includes a driving roller 216*a*, a tension roller 216*b*, an intermediate transfer belt 216, a belt cleaner 218*b* that serves as a cleaning unit, and a secondary transfer roller 217. The intermediate transfer belt 216 is stretched and wound around the driving roller 216*a* and the tension roller 216*b*. In addition, inside the intermediate transfer belt 216, primary transfer rollers 219 are disposed at positions that face the respective photosensitive drums 212 via the intermediate transfer belt 216. The intermediate transfer belt 216 is rotated counterclockwise in FIG. 1 by the driving roller 216*a*, which is driven by a driving portion (not illustrated). Note that each of the drum cleaner 218*a* and the belt cleaner 218*b* may be an elastic blade that scrapes sticking substance, such as toner, from a member to be cleaned, or may be a brush member that slides on the surface of a member to be cleaned.

At a position facing the driving roller 216*a* via the intermediate transfer belt 216, the secondary transfer roller 217 is disposed for transferring a color image borne on the intermediate transfer belt 216, onto the sheet P. Between the secondary transfer roller 217 and the driving roller 216*a*, a transfer portion (secondary transfer portion) is formed as a nip portion in which a toner image is transferred onto the sheet P.

Above the secondary transfer roller 217, the fixing portion 220 is disposed; and above the fixing portion 220, a discharging roller 225 and a both-sides reversing portion 201D are disposed. The fixing portion 220 includes a roller pair that nips and conveys the sheet P, and a heating unit that heats an image formed on the sheet P. The roller pair is constituted by elements, each of which may be a roller or a belt. The heating unit may be a halogen lamp, a ceramic heater, an induction heating mechanism, or the like. The both-sides reversing portion 201D includes a reversing roller 222 and a reconveyance path R. The reversing roller 222 can rotate in forward and reverse directions.

Next, an image forming operation of the image forming apparatus 201 will be described. When an instruction to execute an image forming operation is given to the image forming apparatus 201, a controller of the image forming apparatus 201 starts the image forming operation for forming an image on the sheet P in accordance with image information. Specifically, the controller receives image information sent from an external apparatus or causes the image reading apparatus 202 to read image information from a document; and sends a signal (video signal) based on the image information, to the laser scanner 210 of the image forming portion 201B.

In each of the process cartridges PY to PK of the image forming portion 201B, the photosensitive drum 212 is driven and rotated, and the surface of the photosensitive drum 212 is uniformly charged by the charger 213 so that the surface of the photosensitive drum 212 has predetermined polarity and electric potential. The laser scanner 210 emits a laser beam to the photosensitive drum 212 in accordance with the video signal, and exposes the photosensitive drum 212 with the laser beam. With this operation, an electrostatic latent image is formed on the surface of the photosensitive drum 212. The development unit 214 develops the electrostatic latent image by using developer that contains toner, and visualizes the electrostatic latent image as a monochrome toner image of yellow, magenta, cyan, or black. The monochrome toner images borne on the photosensitive drums 212 are primary-transferred onto the intermediate transfer belt 216 by the primary transfer rollers 219. The monochrome toner images having respective colors are primary-transferred onto the intermediate transfer belt 216 such that one toner image is put on another, so that a full-color toner image is formed on the intermediate transfer belt 216. Through the above-described processes (image forming process), the image forming portion 201B forms an image (toner image) to be formed on the sheet P.

In parallel with the image forming process performed by the image forming portion 201B, the sheet P is fed, one by one, from one of the feeding trays 7*a* to 7*e*. The sheet P is conveyed through conveyance rollers 8*a*, 8*b*, and 8*c* and through a pre-registration roller (hereinafter, referred to as a pre-registration roller) 8, to a registration roller (hereinafter, referred to as a registration roller) 15. The conveyance rollers 8*a* to 8*c*, the pre-registration roller 8, and the registration roller 15 are roller pairs, each of which is constituted by rollers that are in contact with each other. When the rollers are rotated while nipping the sheet P in a nip portion between the rollers, the sheet P is conveyed by the rollers. Thus, the conveyance rollers 8*a* to 8*c*, the pre-registration roller 8, and the registration roller 15 function as conveyance units that convey the sheet P.

The registration roller 15 corrects the skew of the sheet P, and then conveys the sheet P to the secondary transfer portion so that the sheet P reaches the secondary transfer portion at a timing at which the toner image formed by the image forming portion 201B and borne on the intermediate transfer belt 216 reaches the secondary transfer portion. In the secondary transfer portion, a bias voltage (transfer voltage) is applied to the secondary transfer roller 217, so that the toner image is secondary-transferred from the intermediate transfer belt 216 to the sheet P.

Then, the sheet P is conveyed to the fixing portion 220, and is applied with heat and pressure in the fixing portion 220. As a result, the toners having different colors are melted and mixed with each other, so that the toner image is fixed to the sheet P, as a color image. The sheet P to which the image has been fixed is then discharged into the discharging space portion formed below the image reading apparatus 202, by the discharging roller 225; and is stacked. In a case where images are to be formed on both sides of the sheet P, after a toner image is transferred and fixed to a first surface of the sheet P, the sheet P is conveyed to the reconveyance path R by the reversing roller 222 rotating in a reverse direction (that is, switch-backing), and is conveyed to the image forming portion 201B again. After that, a toner image is transferred and fixed to a second surface of the sheet P opposite to the first surface, and the sheet P is discharged into the discharging space portion by the discharging roller 225, and is stacked.

In the following description, an exposing position of the photosensitive drum 212 of the process cartridge PY of yellow at which the photosensitive drum 212 is irradiated with the laser beam emitted from the laser scanner 210 is referred to as an exposing position (ay). Similarly, an exposing position of the photosensitive drum 212 of the process cartridge PM of magenta at which the photosensitive drum 212 is irradiated with the laser beam emitted from the laser scanner 210 is referred to as an exposing position (am), an exposing position of the photosensitive drum 212 of the process cartridge PC of cyan at which the photosensitive drum 212 is irradiated with the laser beam emitted from the laser scanner 210 is referred to as an exposing position (ac), and an exposing position of the photosensitive drum 212 of the process cartridge PK of black at which the photosensitive drum 212 is irradiated with the laser beam emitted from the laser scanner 210 is referred to as an exposing position (ak). In addition, the position of the secondary transfer portion, which is a nip portion between the secondary transfer roller 217 and the driving roller 216*a*, is denoted by (j). In addition, the distance from the exposing position (ay) of the photosensitive drum 212 to the secondary transfer portion (j) is denoted by Ly, the distance from the exposing position (am) of the photosensitive drum 212 to the secondary transfer portion (j) is denoted by Lm, the distance from the exposing position (ac) of the photosensitive drum 212 to the secondary transfer portion (j) is denoted by Lc, and the distance from the exposing position (ak) of the photosensitive drum 212 to the secondary transfer portion (j) is denoted by Lk. For example, the distance Ly from the exposing position (ay) of the photosensitive drum 212 of yellow to the secondary transfer portion (j) is the sum of the length of a path from the exposing position (ay) to a surface of the photosensitive drum 212 and the length of a path extending from the surface of the photosensitive drum 212 to the secondary transfer portion (j) along the surface of the intermediate transfer belt 216. In other words, the distance Ly is a distance by which the pixels, which form an electrostatic latent image on the photosensitive drum 212, move while the pixels are developed into the toner image after the formation of the electrostatic latent image and reach the position (i.e., the secondary transfer portion (j)) at which a toner image is transferred onto the sheet P.

Sheet Feeding Path

Figure 2:
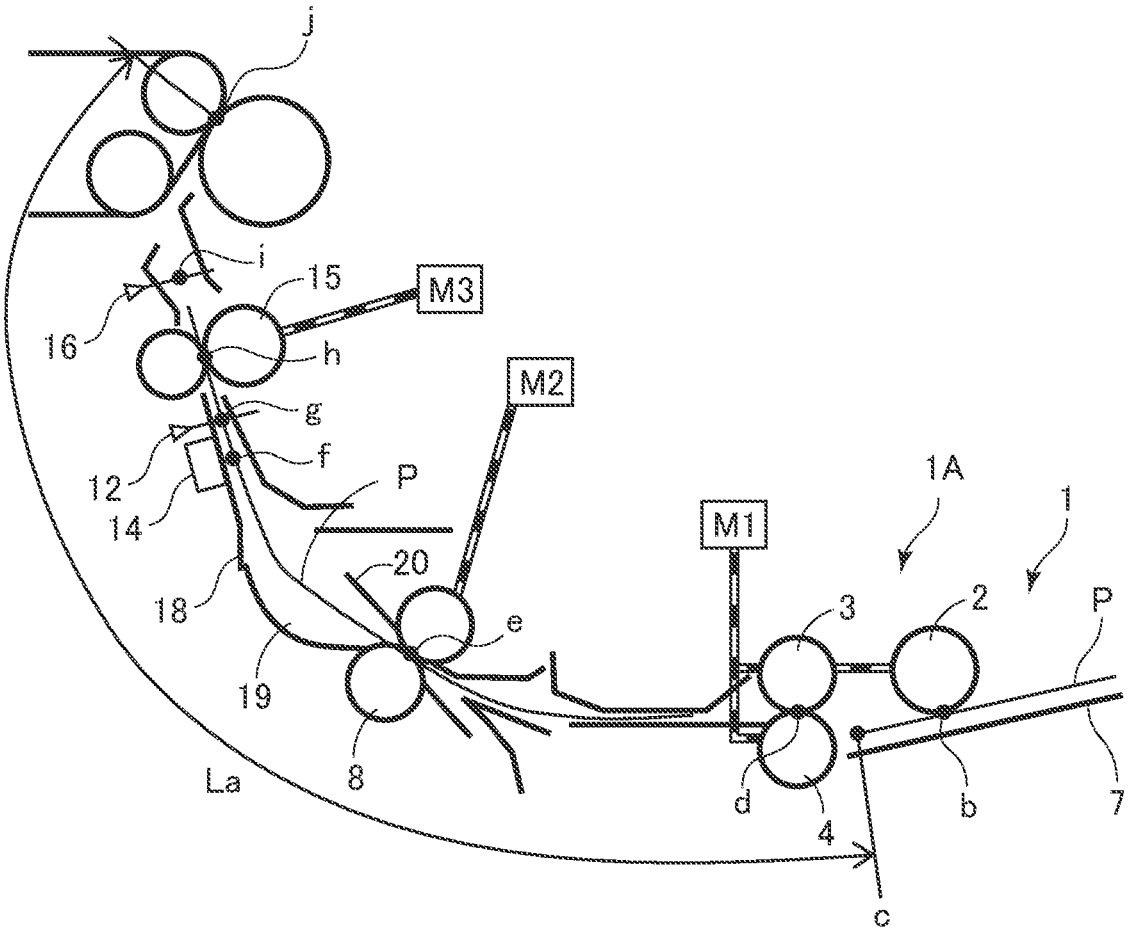
FIG. 2 is a diagram illustrating a sheet feeding path of an image forming apparatus of an embodiment.

FIG. 2 is a schematic diagram illustrating a feeding path (conveyance path) extending from the sheet feeding apparatus 1 to the secondary transfer portion (j) in the image forming apparatus of the present embodiment. In FIG. 2, a feeding tray 7 is any one of the feeding trays 7*a* to 7*e* illustrated in FIG. 1.

On the feeding path extending from the feeding tray 7 to the secondary transfer portion (j), the pickup roller 2, the feed roller 3, the retard roller 4, the pre-registration roller 8, and the registration roller 15 are disposed from the upstream side toward the downstream side of the feeding path. In addition, at a plurality of positions on the feeding path, sensors (12, 14, and 16) that detect the sheet P are disposed.

The pickup roller 2, the feed roller 3, and the retard roller 4, which are disposed in the sheet feeding apparatus 1, are driven by a feed motor M1 that is a common driving source. The retard roller 4 is connected with the feed motor M1 via a torque limiter (not illustrated), and is applied with a driving force toward a direction (i.e., a clockwise direction in FIG. 2) opposite to the conveyance direction of the sheet P. The pre-registration roller 8 is driven by a pre-registration motor M2. The registration roller 15 is driven by a registration motor M3.

When the sheets P are fed, the pickup roller 2 is driven by the feed motor M1 in a state where the pickup roller 2 is in contact with the top surface of the sheets P stacked on the feeding tray 7. Specifically, the pickup roller 2 is in contact with the top surface of the sheets P at a predetermined contact pressure at an abutment position (b). The sheet P fed by the rotation of the pickup roller 2 is conveyed from a tray leading-edge position (c) to a separation nip (d) formed between the feed roller 3 and the retard roller 4. The tray leading-edge position (c) is a reference position for the leading edge of the sheet P (i.e., the downstream edge of the sheet P in the sheet conveyance direction) placed on the feeding tray 7. For example, the tray leading-edge position (c) is the position of a wall surface of the downstream edge of the feeding tray 7 in the sheet conveyance direction.

When the sheet P is not present in the separation nip (d), or when the single sheet P is being conveyed through the separation nip (d), the torque limiter (not illustrated) slips, and the retard roller 4 rotates in a direction (i.e., a counter-clockwise direction in FIG. 2) opposite to a direction toward which the driving force is applied to the retard roller 4. That is, the retard roller 4 rotates in accordance with the feed roller 3 or the sheet P. If a plurality of sheets P that are superposed on each other enters the separation nip (d), the retard roller 4 rotates in the same direction as the direction toward which the driving force is applied to the retard roller 4. Since the superposed sheets P slip on each other, only the uppermost sheet P that is in contact with the feed roller 3 is conveyed downstream in the sheet conveyance direction, and the other sheets P are pushed back toward the feeding tray 7 by the retard roller 4. In this manner, the sheet P conveyed to the separation nip (d) is separated from the other, one by one, by the feed roller 3 and the retard roller 4, and is fed to a nip portion (e) of the pre-registration roller 8 located downstream in the sheet conveyance direction.

The leading edge of the sheet P conveyed by the pre-registration roller 8 is detected by the registration sensor (hereinafter, referred to as a pre-registration sensor) 12 at a detection position (g) of the pre-registration sensor 12. The pre-registration sensor 12 is located downstream of the nip portion (e) of the pre-registration roller 8. Then, the leading edge of the sheet P abuts against a nip portion (h) of the registration roller 15, so that the bend (loop) of the sheet P is formed and the skew of the leading edge of the sheet P is corrected such that the leading edge of the sheet P is aligned with the nip portion (h). Conveyance guides 18 and 20 are disposed between the pre-registration roller 8 and the registration roller 15, and form a loop space portion 19 that allows the formation of the loop of the sheet P. Note that as described below, also in the pre-registration roller 8, the leading edge of the sheet P abuts against the pre-registration roller 8, and the skew of the sheet P is corrected (preliminary skew correction). In addition to this, after the leading edge of the sheet P abuts against the registration roller 15, the registration roller 15 is driven and rotated in a reverse direction, as described below. Thus, with these operations, the skew correction can be performed with higher accuracy.

After the leading edge of the sheet P abuts against the registration roller 15, the registration roller 15 remains in a stop state for a predetermined time. While the registration roller 15 is in the stop state, an edge position of the sheet P in a sheet width direction (i.e., a direction orthogonal to the sheet conveyance direction) is detected by the lateral-registration sensor 14 at a detection position (f) of the lateral-registration detection sensor 14. After the conveyance of the sheet P is started by the registration roller 15, the leading edge of the sheet P is detected by the post-registration sensor 16, located downstream of the nip portion (h) of the registration roller 15, at a detection position (i) of the post-registration sensor 16.

The registration roller 15 is driven and controlled so that the timing at which the leading edge of the sheet P reaches the secondary transfer portion (j) is synchronized with the timing at which the toner image borne on the intermediate transfer belt 216 is conveyed to the secondary transfer portion (j). In addition, in a period of time from when the leading edge of the sheet P passes through the secondary transfer portion (j), until the trailing edge of the sheet P passes through the secondary transfer portion (j), the toner image formed on the intermediate transfer belt 216 is transferred onto the sheet P in a sequential manner.

In the above-described feeding path, a distance from the tray leading-edge position c to the secondary transfer portion (j) is denoted by La. The distance La is measured along a typical trajectory along which the sheet P passes. In other words, the distance La is a distance by which the leading edge of the sheet P placed on the feeding tray 7 will move until the leading edge of the sheet P reaches the position (i.e., the secondary transfer portion (j)) at which the toner image is transferred onto the sheet P.

Control Block Diagram

Figure 3:
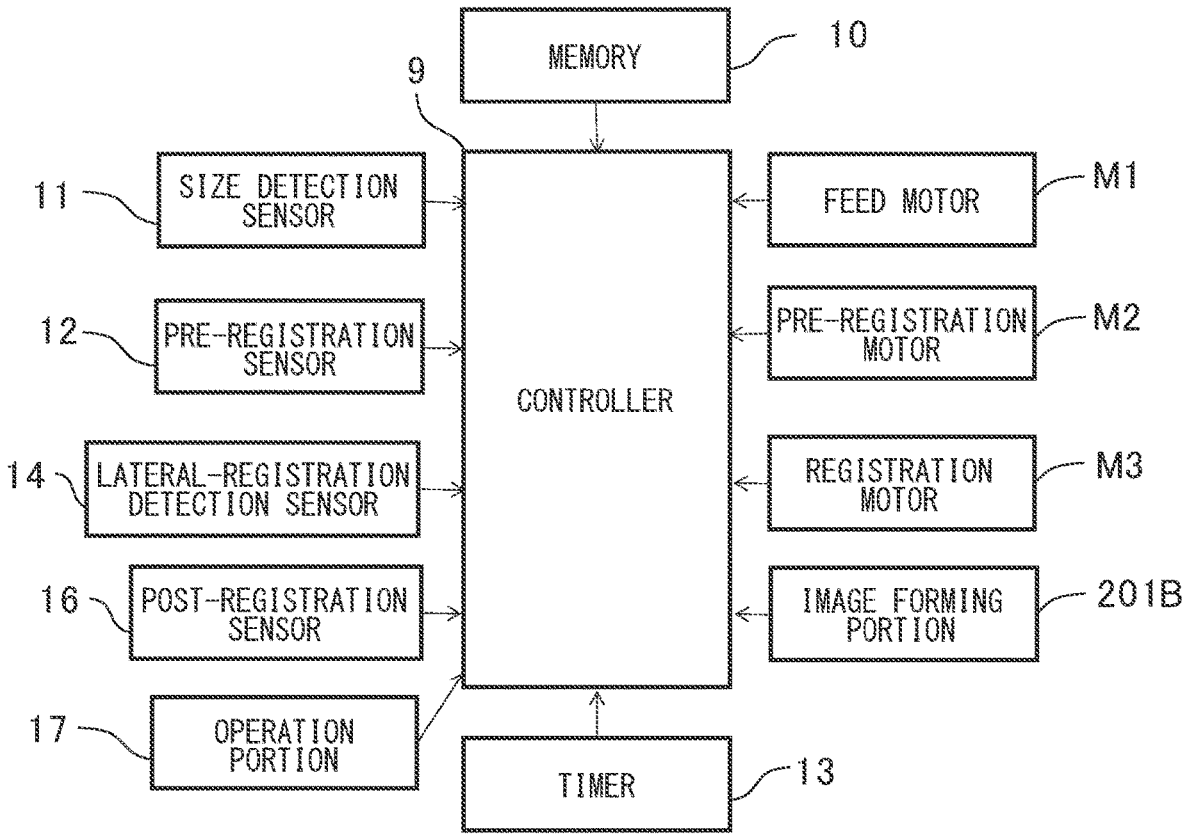
FIG. 3 is a block diagram illustrating a control system of an image forming apparatus of an embodiment.

FIG. 3 is a block diagram of a control system of the image forming apparatus 201 of the present embodiment. A controller 9 is connected with a size detection sensor 11, the pre-registration sensor 12, the lateral-registration detection sensor 14, and the post-registration sensor 16. The size detection sensor 11 detects the size of the sheet P stacked on the feeding tray 7; and the pre-registration sensor 12, the lateral-registration detection sensor 14, and the post-registration sensor 16 are disposed on the conveyance path. The pre-registration sensor 12 and the post-registration sensor 16 detect the sheet P on the feeding path. Each of the pre-registration sensor 12 and the post-registration sensor 16 may be a reflective optical sensor or a transmissive optical sensor. The reflective optical sensor emits light toward the feeding path, and detects the light reflected from the sheet P. The transmissive optical sensor detects the swing of a flag (that projects from the feeding path) caused by the sheet P abutting against the flag. The lateral-registration detection sensor 14 is a detection portion (position detector) that is disposed on the feeding path, and that detects the position of the sheet P in the sheet width direction. The lateral-registration detection sensor 14 may be an image sensor, such as a contact image sensor (CIS) unit that includes light receiving elements arranged in the sheet width direction.

In addition, the controller 9 is connected with the feed motor M1, the pre-registration motor M2, the registration motor M3, the image forming portion 201B, and an operation portion 17; and can be communicatively connected to an external computer via a network. As described above, the feed motor M1, the pre-registration motor M2, and the registration motor M3 are actuators (driving sources) for conveying the sheet P, and are driven and controlled by a driving signal from the controller 9. The image forming portion 201B executes an image forming process, depending on a video signal and an instruction sent from the controller 9. The operation portion 17 is a user interface of the image forming apparatus 201, and includes a display apparatus such as a liquid crystal panel, and an input apparatus including a touch-panel function portion of the liquid crystal panel and a ten-key pad. A user can give setting information to the controller 9, and instruct the controller 9 to execute an image forming operation, by operating the operation portion 17 or a driver software of an external computer connected with the controller 9. For example, a user can instruct the controller 9 to change one of below-described modes: a high-productivity mode, a balance mode, and a high-accuracy mode, to another by operating the buttons and/or the touch panel; and the controller 9 determines the mode, depending on the instruction from the user.

In addition, the controller 9 is connected with a memory 10 and a timer 13. The memory 10 functions as a storage (i.e., a computer-readable non-transitory storage medium) that stores a program to be executed by the controller 9 and data necessary for executing the program. The memory 10 is constituted by pieces of hardware, such as a ROM, a RAM, and an EEPROM. The timer 13 generates a control time used by the controller 9 for executing a program. The controller 9 includes at least one processor, and controls the operation (e.g., the execution of an image forming job) of the image forming apparatus 201 by reading a program stored in the memory 10 and executing the program. When the controller 9 controls the operation of the image forming apparatus 201, the controller 9 drives the feed motor M1, the pre-registration motor M2, and the registration motor M3 and controls the image forming portion 201B, depending on image information sent from the image reading apparatus 202 or an external computer, and on an instruction inputted via the operation portion 17 or the external computer.

The image forming job (hereinafter, referred to simply as a job) is a series of tasks performed depending on a signal (print signal) that instructs the image forming apparatus 201 to form an image on a sheet. A single job includes the above-described image forming operation, which includes a sheet conveyance process and an image forming process. The sheet conveyance process is a process in which a predetermined number of sheets P is fed from predetermined one of the feeding trays 7*a* to 7*e* and conveyed, depending on the setting information of the job; and the image forming process is performed by the image forming portion 201B. In addition, the job includes an advance preparation of an image forming process and a process performed as a post-process.

In the present embodiment, a process for forming an image to be formed on a sheet means an image forming process performed by the image forming portion 201B. In addition, the start of formation of an image means the start of formation of an electrostatic latent image on the photosensitive drum 212, for forming the image, in the process cartridge PY, which is the first process cartridge of the plurality of process cartridges.

In addition, in the following description, the lateral-registration position means a position of a sheet detected by the lateral-registration detection sensor 14, which serves as a detection portion, in the sheet width direction (i.e., the main scanning direction in image formation). The lateral-registration position is detected by the lateral-registration detection sensor 14 on the feeding path extending from the feeding trays 7*a* to 7*e* to the image forming portion 201B. In addition, the lateral-registration position information is position information that represents a position of a sheet (fed from one of the feeding trays 7*a* to 7*e* to the image forming portion 201B) in the sheet width direction, and that is used by the image forming portion 201B for forming an image. More specifically, in accordance with the side-edge position of a sheet represented by the lateral-registration position information, the image forming portion 201B corrects the starting position of forming an electrostatic latent image in the main scanning direction (i.e., the sheet width direction). The electrostatic latent image is formed by the laser scanner 210 on each of the photosensitive drums 212. Note that the side-edge position of a sheet represented by the lateral-registration position information is not necessarily equal to the starting position of forming an electrostatic latent image, which is formed by the laser scanner 210. That is, there is a case in which the starting point of forming an electrostatic latent image is shifted by a predetermined margin, for example. As described below, a plurality of values is set as the lateral-registration position information, in accordance with various conditions. For example, the plurality of values is set in accordance with an execution mode of the image forming job, and with what number sheet a current sheet is in the image forming job.

Control Mode of Image Forming Job

Next, modes used when an image forming job is executed by the image forming apparatus 201 of the present embodiment will be described. In the present embodiment, one of three modes: a high-productivity mode, a balance mode, and a high-accuracy mode can be selected for each job. The high-productivity mode is a mode in which the priority is given to the productivity, the balance mode is a mode intended to achieve both of high productivity and high positional accuracy of image, and the high-accuracy mode is a mode in which the priority is given to the positional accuracy of image.

The high-productivity mode has excellent FPOT and throughput (i.e., the number of sheets on which images are formed and which are outputted per minute), and is suitable for use in an ordinary office environment and the like. The balance mode can ensure a certain level of positional accuracy of image while improving the FPOT and the throughput. The balance mode is suitable for printed matter, such as direct mails (postcards), POP, and advertisements, that requires a certain level of positional accuracy of image and high productivity. The high-accuracy mode can achieve high positional accuracy of image, and thus is suitable for printed matter, such as pamphlets and business cards customized for each customer, in which the priority is given to the positional accuracy of image rather than the productivity.

As described below, in the present embodiment, the control is performed for shortening the FPOT while suppressing the deterioration of positional accuracy of image, in the high-productivity mode and the balance mode.

Figure 4:
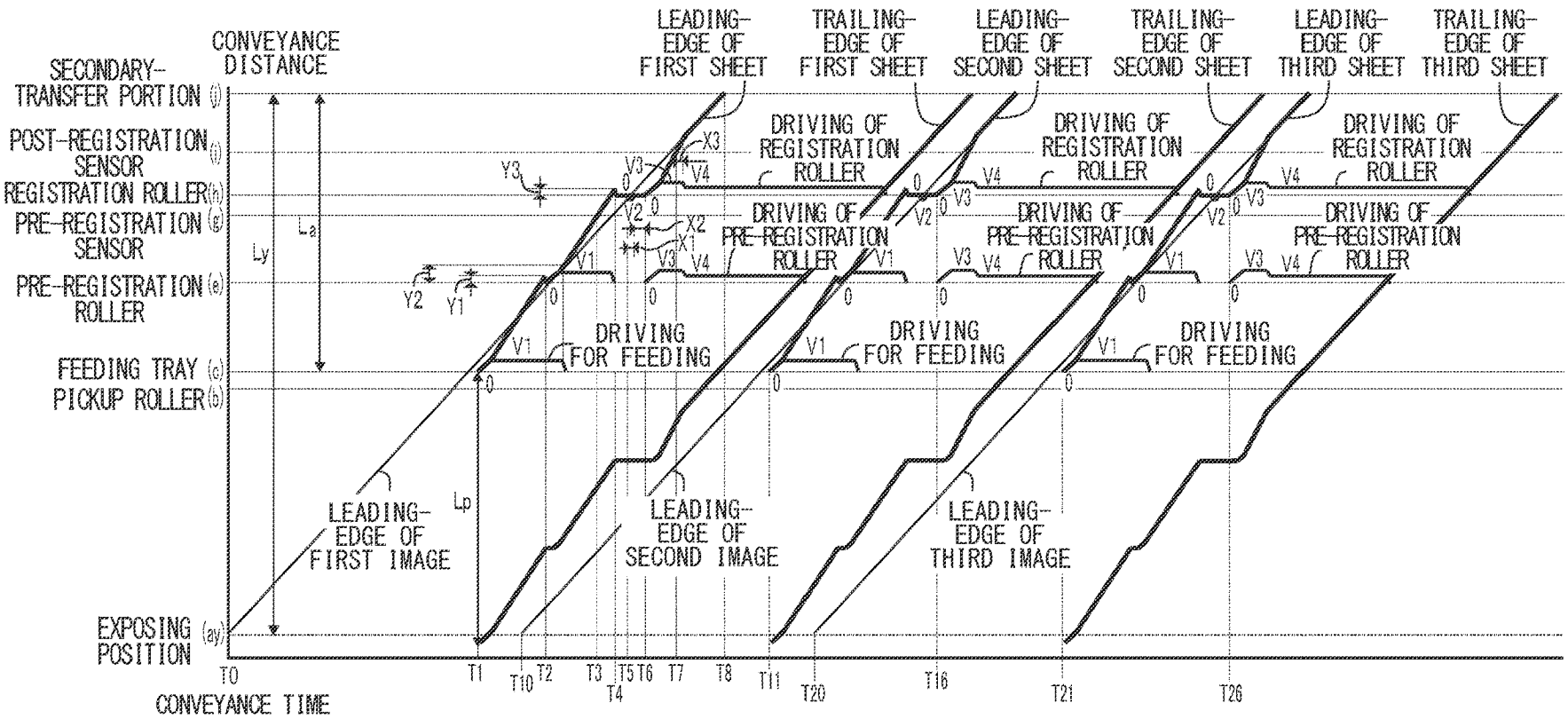
FIG. 4 is a conveyance chart and a driving chart illustrating an example of operation of a high-productivity mode of an embodiment.
Figure 5:
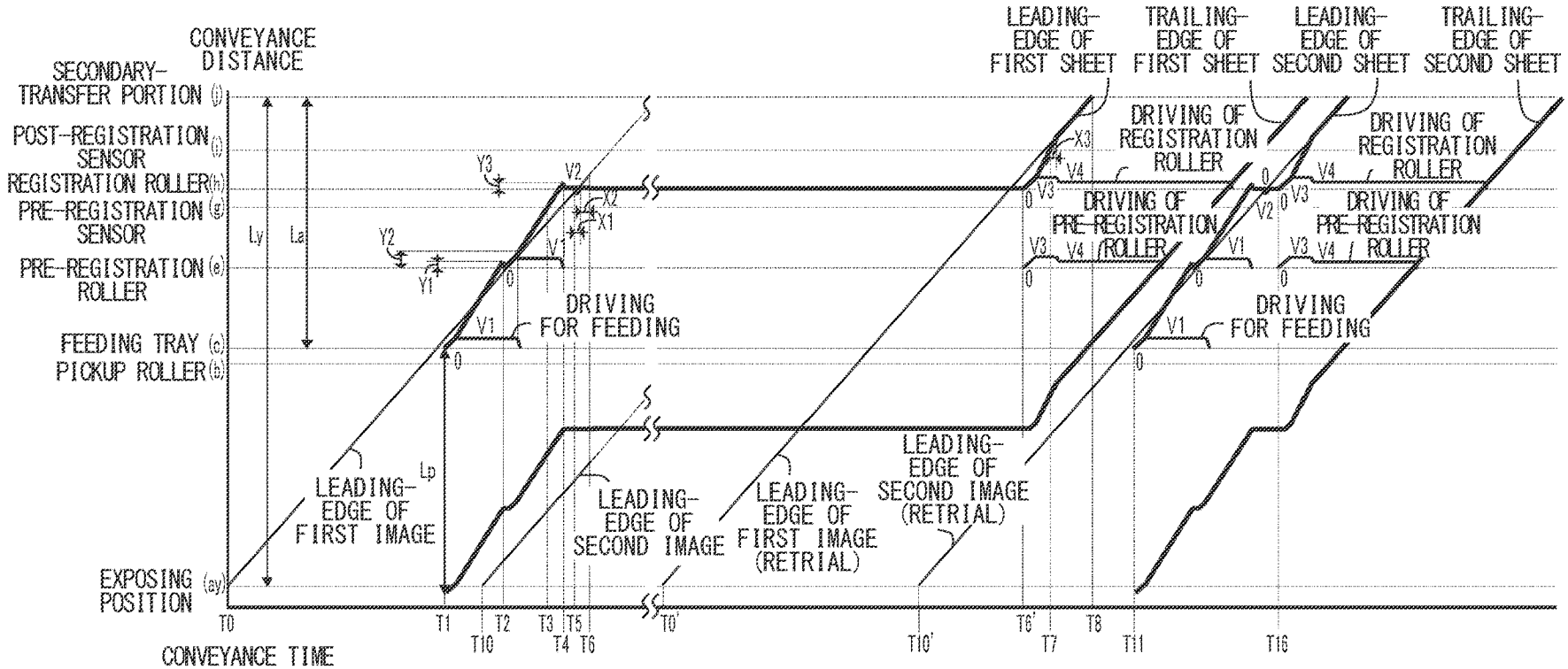
FIG. 5 is a conveyance chart and a driving chart illustrating an example of operation of a balance mode of an embodiment.
Figure 6:
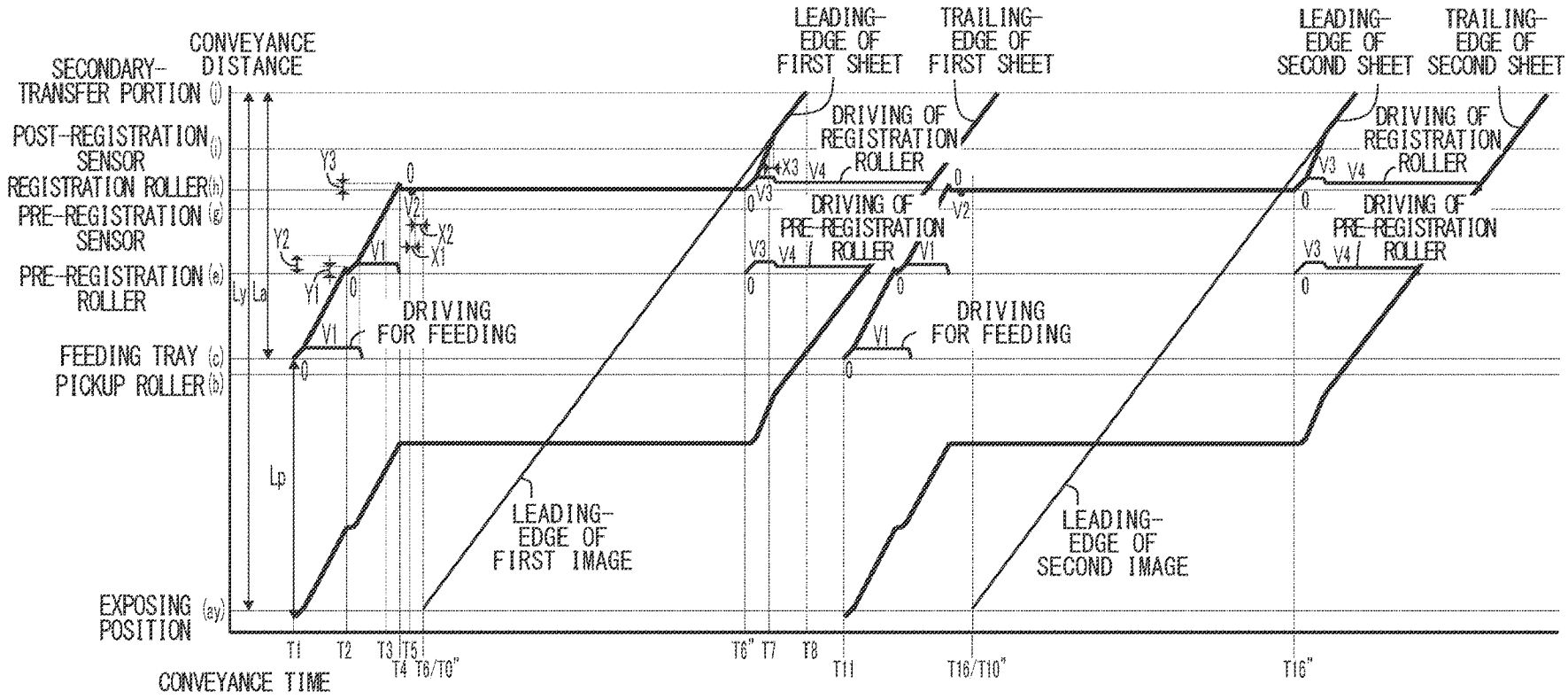
FIG. 6 is a conveyance chart and a driving chart illustrating an example of operation of a high-accuracy mode of an embodiment.

Each of FIGS. 4 to 6 is a diagram in which a conveyance chart and a driving chart are combined with each other. The conveyance chart illustrates positions of a sheet in each mode, and the driving chart illustrates driving signals applied to each motor. FIG. 4 illustrates the high-productivity mode, FIG. 5 illustrates the balance mode, and FIG. 6 illustrates the high-accuracy mode. In each of FIGS. 4 to 6, the horizontal axis represents the time having elapsed since a predetermined control time in a job. The vertical axis is an axis on which the position of a sheet on the feeding path and the position of an image on the conveyance path, which extends from the exposing position (ay) to the secondary transfer portion (j), are superposed on each other, with the secondary transfer portion (j) serving as a reference point.

A line indicated by a term "leading edge of sheet" shown in FIGS. 4 to 6 is a theoretical line (i.e., a line of control target) that represents the position of the leading edge of each sheet, and a line indicated by a term "trailing edge of sheet" is a theoretical line that represents the position of the trailing edge of each sheet. In addition, a line indicated by a term "leading edge of image" is a theoretical line that represents the position of the leading edge of a toner image formed in the process cartridge PY of yellow. The theoretical line that represents the position of the trailing edge of a sheet can be determined by performing a calculation by using the information on the theoretical line of the leading edge of the sheet and a length Lp of the sheet P in the sheet conveyance direction.

In addition, a driving signal (indicated as "driving for feeding") applied to the feed motor M1 is shown on a line that represents the tray leading-edge position c of the feeding tray 7. Similarly, a driving signal (indicated as "driving of pre-registration roller") applied to the pre-registration motor M2 is shown on a line that represents the position of the nip portion (e) of the pre-registration roller 8. Similarly, a driving signal (indicated as "driving of registration roller") applied to the registration motor M3 is shown on a line that represents the position of the nip portion (h) of the registration roller 15. A driving signal applied to each motor is shown, provided with a circumferential speed (V1 to V4) of a corresponding roller. The speed V1 is a speed (feeding speed) at which the sheet P is fed from the feeding tray 7 toward the registration roller 15. The speed V2 is a speed (registration-roller reverse-rotation speed) at which the registration roller 15 is rotated in a reverse direction for correcting the skew of the sheet P in the nip portion of the registration roller 15. The speed V3 is a speed (registration-roller ON speed) at which the registration roller 15 starts to convey the skew-corrected sheet P toward the secondary transfer portion (j). The speed V4 is a speed (process speed, image forming speed) which is equal to a toner-image forming speed of the image forming portion 201B in the sub-scanning direction. Normally, the registration-roller ON speed V3 is higher than the process speed V4.

Sequence of High-Productivity Mode

First, the control performed in the high-productivity mode will be described with reference to FIG. 4. In the high-productivity mode, at a control time T0, the laser scanner 210 starts the formation of an image to be formed on the first sheet, at the exposing position (ay). After that, at a control time T1, the feed motor M1 drives the pickup roller 2 at the feeding speed V1, so that the feeding of the sheet P is started. The pre-registration roller 8 is in a stop state until a control time T2. After the sheet P is abutted against the nip portion of the pre-registration roller 8 that is in a stop state, the sheet P is further conveyed by a predetermined distance Y1. With this operation, the bend (loop) of the sheet P is formed, and the leading edge of the sheet P is aligned with the nip portion of the pre-registration roller 8. In this manner, simplified skew correction is performed on the sheet P, and variations of leading-edge position of the sheet P are reduced. At the control time T2, the pre-registration motor M2 starts the rotation of the pre-registration roller 8 at the feeding speed V1. After that, at a timing at which the sheet P has been conveyed by a predetermined distance Y2, the feed motor M1 is stopped.

The leading edge of the sheet P conveyed by the pre-registration roller 8 is detected by the pre-registration sensor 12 at the detection position (g). The time at which the leading edge of the sheet P is detected by the pre-registration sensor 12 is defined as a control time T3. Based on the control time T3, the pre-registration roller 8 further conveys the sheet P, after the leading edge of the sheet P abuts against the nip portion of the registration roller 15 that is in a stop state, by a predetermined distance Y3 until a control time T4. At the control time T4, the pre-registration motor M2 is stopped. With this operation, the bend (loop) of the sheet P is formed between the pre-registration roller 8 and the registration roller 15.

Until a predetermined time has elapsed since the control time T4, the pre-registration roller 8 is in a stop state. During the period of time in which the pre-registration roller 8 is in a stop state, the registration roller 15 is rotated for a predetermined control time X1 in a reverse direction by the registration motor M3, at the registration-roller reverse-rotation speed V2, and then is stopped. With this operation, the leading edge of the sheet P that has been located in the nip portion of the registration roller 15 is pushed back toward the upstream side of the sheet conveyance direction, so that the skew of the sheet P is corrected with higher accuracy. In addition, during a predetermined control time X2 in which the registration motor M3 is in a stop state, a side-edge position (lateral-registration position) of the sheet P whose skew has been corrected by the reverse rotation of the registration roller 15 is detected by the lateral-registration detection sensor 14.

After that, at a control time T6, the registration motor M3 drives the registration roller 15 at the registration-roller ON speed V3, and at substantially the same time, the registration motor M2 drives the pre-registration roller 8 at the registration-roller ON speed V3. With these operations, the conveyance of the sheet P is started. The timing at which the pre-registration roller 8 starts the conveyance of the sheet P is the same as the control time T6, or is a timing after the control time T6 and before the bend (loop) of the sheet P, which was formed when the skew of the sheet P was corrected by the registration roller 15 and which corresponds to the distance Y3, disappears.

The leading edge of the sheet P conveyed by the registration roller 15 is detected by the post-registration sensor 16 at the detection position (i). The time at which the leading edge of the sheet P is detected by the post-registration sensor 16 is defined as a control time T7. When a predetermined control time X3 has elapsed since the control time T7, the driving speed of the registration roller 15 and the pre-registration roller 8 is changed into the process speed V4. The control time X3 is calculated so that the timing at which the leading edge of the sheet P reaches the secondary transfer portion (j) matches the timing (control time T8) at which the leading edge of a toner image to be formed on the sheet P reaches the secondary transfer portion (j).

After that, the sheet P is conveyed by the registration roller 15 at the process speed V4, and the toner image is transferred onto the sheet P in the secondary transfer portion (j). Note that the pre-registration motor M2 is stopped after a sufficient time for the trailing edge of the sheet P to pass through the pre-registration roller 8 has elapsed. Similarly, the registration motor M3 is stopped after a sufficient time for the trailing edge of the sheet P to pass through the registration roller 15 has elapsed.

The control for the first sheet P has been described above. Also for the second and following sheets P, the same control is performed. For example, the formation of an image to be formed on the second sheet P is started at a control time T10, the feeding of the second sheet P at the feeding speed V1 is started at a control time T11, and the registration roller 15 starts to convey the second sheet P toward the secondary transfer portion (j) at a control time T16. Similarly, the formation of an image to be formed on the third sheet P is started at a control time T20, the feeding of the third sheet P at the feeding speed V1 is started at a control time T21, and the registration roller 15 starts to convey the third sheet P toward the secondary transfer portion (j) at a control time T26.

As described above, in the high-productivity mode, before the lateral-registration position of the sheet P is detected by the lateral-registration detection sensor 14 (during the control time X2), the formation of an image to be formed on the sheet P is started (at the control time TO). Thus, the first sheet P is conveyed to the secondary transfer portion (j) at a timing earlier than that in the below-described high-accuracy mode, so that the FPOT is shortened. In addition, since the second and the following sheets P are conveyed under the same control, the throughput of a job (successive-image forming job) that forms images on a plurality of sheets increases.

Sequence of Balance Mode

Next, the control performed in the balance mode will be described with reference to FIG. 5. In the balance mode, as in the high-productivity mode, before the lateral-registration position of the sheet is detected by the lateral-registration detection sensor 14, the formation of an image to be formed on the sheet is started. Thus, normally in the balance mode, the short FPOT and the high throughput can be achieved, as in the high-productivity mode. However, if the difference between the lateral-registration position of the sheet P detected by the lateral-registration detection sensor 14 and the lateral-registration position information used for forming an image has exceeded a predetermined threshold Δy, the formation of the image to be formed on the sheet P is canceled. In this case, by using the detected lateral-registration position of the sheet P, an operation (retrial operation) for newly forming an image is performed.

On the other hand, if the difference between the lateral-registration position of the sheet P detected by the lateral-registration detection sensor 14 and the lateral-registration position information used for forming an image has not exceeded the predetermined threshold Δy, the same control as that in the high-productivity mode is performed. Thus, in the present embodiment, the control performed when the difference has exceeded the threshold Δy will be described.

As illustrated in FIG. 5, after the skew of the sheet P is corrected by the reverse rotation of the registration roller 15, and during the predetermined control time X2 in which the registration motor M3 is in a stop state, a side-edge position of the skew-corrected sheet P is detected by the lateral-registration detection sensor 14. Suppose that the difference between the lateral-registration position of the sheet P detected by the lateral-registration detection sensor 14 and the lateral-registration position information used for forming an image has exceeded the predetermined threshold Δy.

In this case, the registration roller 15 is not driven by the registration motor M3 at the control time T6, and the stop state of the registration roller 15 and the pre-registration roller 8 is continued. In addition, the formation of images to be formed on the first and the second sheets P, which has already been started, is canceled. The toner images formed on the photosensitive drums 212 of the process cartridges PY to PK and the toner image formed on the intermediate transfer belt 216 are removed, for example, by applying a voltage with a polarity opposite to a polarity of a voltage applied when the toner images are formed; and the toner is collected by the cleaning unit.

At a control time T0' after the cleaning of the photosensitive drums 212 and the intermediate transfer belt 216 is completed, the formation of an image to be formed on the first sheet P is started. Note that the image to be newly formed on the first sheet P has been corrected in the sheet width direction (main scanning direction) in accordance with the lateral-registration position of the first sheet P detected by the lateral-registration detection sensor 14. In addition, at a control time T10', the formation of an image to be formed on the second sheet P is started. The period of time between the control time T10' and the control time T0' is the same in length as the period of time (i.e., the period of time between the control time T10 and the control time TO) in the normal image-forming operation.

After that, at a control time T6' at which the image forming process performed by the image forming portion 201B has proceeded to a stage that corresponds to the position of the sheet P waiting at the registration roller 15, the conveyance of the sheet P is started by the registration motor M3 driving the registration roller 15 at the registration-roller ON speed V3. The control performed after this operation is the same as that in the high-productivity mode. That is, after the leading edge of the sheet P is detected by the post-registration sensor 16 at the control time T7, the driving speed of the registration roller 15 and the pre-registration roller 8 is changed into the process speed V4 when the control time X3 has elapsed. The control time X3 is calculated so that the leading edge of the sheet P and the leading edge of the image will reach the secondary transfer portion (j) at the same time. With this operation, the sheet P is conveyed at the process speed V4, and the toner image is transferred onto the sheet P in the secondary transfer portion (j).

Note that also in a case where the second and the following sheets P are conveyed, the difference between the lateral-registration position of a sheet P detected by the lateral-registration detection sensor 14 and the lateral-registration position information used for forming an image may exceed the predetermined threshold Δy. In this case, as described for the first sheet P, the conveyance of the sheet is stopped, and the formation of images to be formed on the sheet and the following sheet is retried.

By the way, if the difference between the lateral-registration position of the first sheet P detected by the lateral-registration detection sensor 14 and the lateral-registration position information used for forming an image has exceeded the threshold Δy as described above, not only the formation of an image to be formed on the first sheet P but also the formation of an image to be formed on the second sheet P is retried. This is because the formation of the image to be formed on the second sheet is started before the lateral-registration position of the first sheet P is detected by the lateral-registration detection sensor 14, for increasing the throughput by reducing the conveyance intervals of sheets in the secondary transfer portion (j). In other words, the image forming apparatus can form successive images at high throughput in the balance mode as long as the difference between the lateral-registration position of the sheet P detected by the lateral-registration detection sensor 14 and the lateral-registration position information used for forming an image does not exceed the threshold Δy.

Such a case that the difference between the detected lateral-registration position and the lateral-registration position information exceeds the threshold Δy tends to occur, if a distance Ly from the exposing position (ay) to the secondary transfer portion (j) is larger than a distance from the detection position (f) (FIG. 2) of the lateral-registration detection sensor 14 to the secondary transfer portion (j), and if the difference between the above-described distances is larger (than the length of a single sheet, for example). Thus, depending on a specific configuration of the image forming apparatus 201 and the length of sheets used for forming images, the formation of images to be formed on three or more sheets may be retried.

Sequence of High-Accuracy Mode

Next, the control performed in the high-accuracy mode will be described with reference to FIG. 6. In the high-accuracy mode, after the lateral-registration position of the sheet P is detected by the lateral-registration detection sensor 14, the formation of an image to be formed on the sheet P is started.

In the above-described high-productivity mode and balance mode, the formation of an image to be formed on the first sheet is started by the image forming portion, before the lateral-registration position of the first sheet is detected by the detection portion, based on the lateral-registration position information obtained from the storage. In contrast, in the high-accuracy mode, the formation of an image to be formed on the first sheet is started by the image forming portion, after the lateral-registration position of the first sheet is detected by the detection portion, based on the lateral-registration position detected by the detection portion.

As illustrated in FIG. 6, in the high-accuracy mode, the conveyance of the first sheet P is started at a control time T1 at the feeding speed V1. The control performed after the control time T1 until a control time T6, which follows the time at which the lateral-registration position of the sheet P is detected by the lateral-registration detection sensor 14, is the same as the control in the high-productivity mode and the balance mode, except that the image forming process is not started.

At a control time T0" after the lateral-registration position of the first sheet P is detected by the lateral-registration detection sensor 14, the image forming process for the first sheet P is started. Note that when the image forming process is started, the toner image formed by the image forming portion 201B has been corrected in the sheet width direction (main scanning direction) in accordance with the lateral-registration position of the first sheet P detected by the lateral-registration detection sensor 14.

After that, at a control time T6" at which the image forming process performed by the image forming portion 201B has proceeded to a stage that corresponds to the position of the sheet P waiting at the registration roller 15, the conveyance of the sheet P is started by the registration motor M3 driving the registration roller 15 at the registration-roller ON speed V3. The control performed after this operation is the same as that in the high-productivity mode. That is, after the leading edge of the sheet P is detected by the post-registration sensor 16 at the control time T7, the driving speed of the registration roller 15 and the pre-registration roller 8 is changed into the process speed V4 when the control time X3 has elapsed. The control time X3 is calculated so that the leading edge of the sheet P and the leading edge of the image will reach the secondary transfer portion (j) at the same time. With this operation, the sheet P is conveyed at the process speed V4, and the toner image is transferred onto the sheet P in the secondary transfer portion (j).

The feeding of the second sheet P is started at a control time T11 after the conveyance of the first sheet P is started by the registration roller 15. The control performed after this operation is the same as the control performed for the first sheet P. That is, at a control time T10" after the lateral-registration position of the second sheet P is detected by the lateral-registration detection sensor 14, the image forming process for the second sheet P is started. Note that when the image forming process is started, the toner image formed by the image forming portion 201B has been corrected in the sheet width direction (main scanning direction) in accordance with the lateral-registration position of the second sheet P detected by the lateral-registration detection sensor 14. After that, at a control time T16", the conveyance of the sheet P is started at the registration-roller ON speed V3. The registration-roller ON speed V3 is then changed into the process speed V4, and the toner image is transferred onto the sheet P in the secondary transfer portion (j).

Thus, in the high-accuracy mode, the formation of an image to be formed on a sheet is started in a job by the image forming portion 201B, based on the lateral-registration position of the sheet detected by the lateral-registration detection sensor 14. In this manner, the image can be formed on the sheet P with higher positional accuracy of image.

Control Method

Figure 9A:
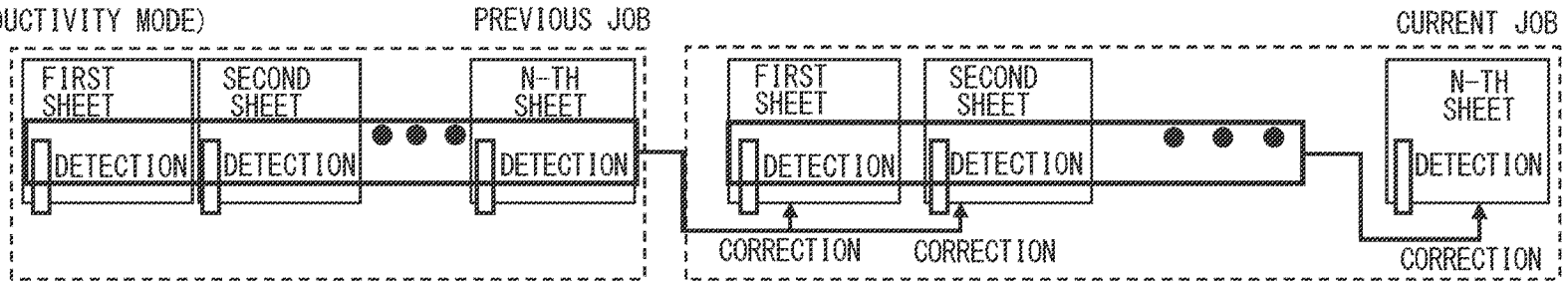
FIG. 9A is a diagram illustrating a relationship between a detection result obtained by a lateral-registration detection sensor in a job in the high-productivity mode of an embodiment and the lateral-registration position information.
Figure 9B:
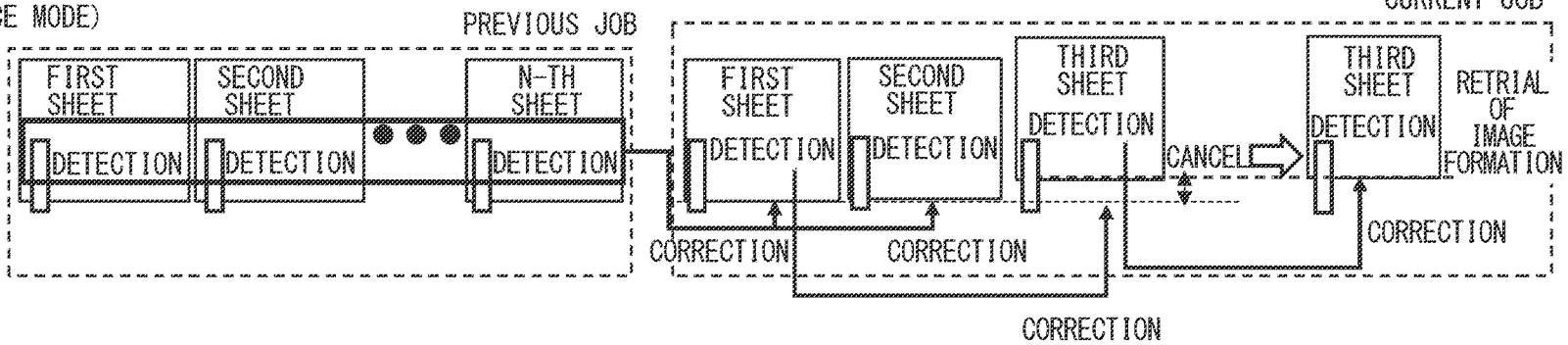
FIG. 9B is a diagram illustrating a relationship between a detection result obtained by the lateral-registration detection sensor in a job in the balance mode of an embodiment and the lateral-registration position information.
Figure 9C:
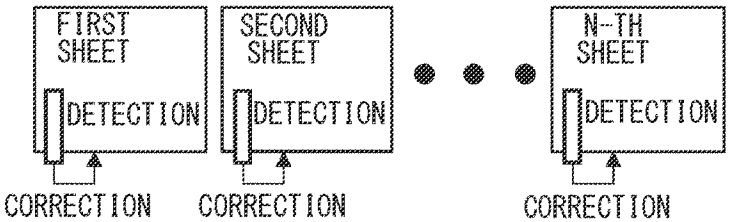
FIG. 9C is a diagram illustrating a relationship between a detection result obtained by the lateral-registration detection sensor in a job in the high-accuracy mode of an embodiment and the lateral-registration position information.

Next, an example of the control method described with reference to FIGS. 4 to 6 and achieving the execution method of an image forming job will be described with reference to a flowchart illustrated in FIG. 7, and to FIGS. 8 and 9. Each process of the flowchart is executed by the controller 9 illustrated in FIG. 3. FIG. 8 is a decision table in which the lateral-registration position information used for forming an image in the present embodiment is shown for each condition. FIGS. 9A to 9C are schematic diagrams for illustrating the lateral-registration position information used in the respective modes. FIG. 9A illustrates the high-productivity mode, FIG. 9B illustrates the balance mode, and FIG. 9C illustrates the high-accuracy mode.

An image forming job is started when an instruction to execute an image forming operation is given to the controller 9. After starting the job, the controller 9 obtains sheet information (sheet category, sheet attribution information) on sheets used in a current job (S1). The sheet information represents at least one of the size, thickness, grammage, and surface property of sheets used in a current job; or represents a combination thereof. The controller 9 receives setting information on the job, from an external computer or the like and analyzes the setting information; and thereby selects a sheet feeding source in the current job, from among the plurality of feeding trays 7*a* to 7*e*. In addition, the controller 9 obtains sheet information on the selected one of the feeding trays 7*a* to 7*e*, from the memory 10. The memory 10 stores sheet information associated with each of the feeding trays 7*a* to 7*e*. The sheet information on each of the feeding trays 7*a* to 7*e* includes size information detected by the size detection sensor 11, and information inputted by a user via the operation portion 17.

Then, the controller 9 selects the execution mode of the current job (S2, S3). The execution mode of the job is specified in advance in the setting information on the job, or is automatically determined by the controller 9, depending on the sheet information of the sheets used in the current job.

If the execution mode is the high-productivity mode, the controller 9 obtains the lateral-registration position information for each item of sheet information (i.e., position information for each type of sheet), stored in the memory 10 (S4). Then, the controller 9 causes the image forming portion 201B to correct the image position in the main scanning direction so that if the lateral-registration position of the sheet P to be actually conveyed is equal to the lateral-registration position information, the image will be formed at an ideal position of the sheet P; and starts the formation of the image (S5). That is, in the high-productivity mode, the formation of an image to be formed on the sheet P is started, before the lateral-registration position of the sheet P is detected by the lateral-registration detection sensor 14, based on the position information (lateral-registration position information) obtained from the memory 10.

As illustrated in FIG. 8, in a job in the high-productivity mode, an image to be formed on the first sheet is formed, based on one of the following pieces of lateral-registration position information. If the sheet information of sheets used in the previous job matches the sheet information of sheets used in a current job, an average value $\Delta av$ of lateral-registration positions obtained in the previous job is used as a lateral-registration position in the current job. If the sheet information of sheets used in the previous job does not match the sheet information of sheets used in the current job, lateral-registration position information $\Delta(0)$ stored in advance in the memory 10 for each item of sheet information and corresponding to the sheet information used in the current job is used. The lateral-registration position information (Δav or Δ(0)) is stored in the memory 10 before the current job is started. Thus, the formation of an image can be started by the image forming portion 201B, before a lateral-registration position Δ(1) of the first sheet is detected by the lateral-registration detection sensor 14, based on the lateral-registration position information (Δav or Δ(0)) that has been read from the memory 10. As a result, the FPOT can be shortened.

The average value Δav of lateral-registration positions obtained in the previous job is lateral-registration position information updated by executing the following steps S13 to S15 in the previous job. In other words, the average value Δav is an average value of lateral-registration positions of sheets detected by the lateral-registration detection sensor 14 in the previous job that has the same sheet information as that of the current job. FIG. 9A illustrates that the mode of the current job is the high-productivity mode, and that since the sheet information of the previous job matches the sheet information of the current job, the position of an image to be formed on the first sheet is corrected, based on the average value Δav of lateral-registration positions obtained in the previous job. That is, if the sheet information of sheets used in the previous job matches the sheet information of sheets used in the current job, the controller 9 causes the image forming portion 201B to start the formation of an image to be formed on the first sheet, before the position of the first sheet is detected by the detection portion, based on the position information (lateral-registration position information) updated in the previous job.

If the sheet information of the previous job matches the sheet information of the current job, the size of sheets stored in one of the feeding trays 7*a* to 7*e*, which is used as a sheet feeding source, has not been changed, and most conditions under which the previous job was executed are the same as those of the current job. Thus, it is expected that the lateral-registration position Δ(1) of the first sheet of the current job detected by the lateral-registration detection sensor 14 has a value near to the average value Δav of lateral-registration positions obtained in the previous job. That is, the high-productivity mode of the present embodiment can shorten the FPOT while suppressing the deterioration of positional accuracy of image.

Note that if a sheet feeding source can be selected from the plurality of sheet stacking portions, and a sheet stacking portion that serves as a sheet feeding source in the previous job does not match a sheet stacking portion that serves as a sheet feeding source in the current job, it is determined that the sheet information of the previous job does not match the sheet information of the current job in the determination of lateral-registration position information. That is, even if the material and size of sheets used in the previous job are actually the same as those of sheets used in the current job, it is determined that the sheet information of the previous job does not match the sheet information of the current job if a sheet feeding source of the previous job does not match a sheet feeding source of the current job. This is because if a sheet feeding source of the previous job is different from a sheet feeding source of the current job, a set position of sheets and a sheet feeding path of the previous job are different from those of the current job and thus, it cannot be expected that the actual difference between the lateral-registration position in the previous job and the lateral-registration position in the current job is slight.

On the other hand, the lateral-registration position information Δ(0), which is preset for each item of sheet information, is preset position information that is set and stored in advance in the memory 10 for each item of sheet information of a sheet, on which the image forming apparatus 201 can form an image. That is, if the sheet information of sheets used in the previous job does not match the sheet information of sheets used in the current job, the controller 9 causes the image forming portion 201B to start the formation of an image to be formed on the first sheet, before the position of the first sheet is detected by the detection portion, based on the preset position information corresponding to the sheet information of the sheets used in the current job. For example, the lateral-registration position information Δ(0) is obtained by forming a test image on a sheet for each item of sheet information in an adjustment process, performed after the image forming apparatus 201 is manufactured and before the image forming apparatus 201 is shipped, and by measuring the positional displacement of the image formed on the sheet; and is stored in the memory 10.

In addition, as illustrated in FIG. 8, in a job in the high-productivity mode, an image to be formed on the second sheet is formed, based on the same lateral-registration position information as that for the image to be formed on the first sheet. FIG. 9A illustrates that the mode of the current job is the high-productivity mode, and that since the sheet information of the previous job matches the sheet information of the current job, the position of an image to be formed on the second sheet is corrected in the current job, based on the average value Δav of lateral-registration positions obtained in the previous job. As described above, this is because the formation of an image to be formed on the second sheet is started before the lateral-registration position of the first sheet P is detected by the lateral-registration detection sensor 14, for increasing the throughput by reducing the conveyance intervals of sheets in the secondary transfer portion (j).

In contrast, as illustrated in FIG. 8, in a job in the high-productivity mode, images to be formed on the third and the following sheets are formed, based on the lateral-registration position information (Δav) updated by executing below-described steps S13 to S15 during the current job. Note that the lateral-registration position information Δav used for forming an image to be formed on the n-th sheet is calculated, based on lateral-registration positions of sheets up to the (n−2)th sheet. FIG. 9A illustrates that the position of an image to be formed on the N-th sheet is corrected, based on a detection result of the lateral-registration positions of a predetermined number of sheets of the current job. That is, the position of an image whose formation is started after the lateral-registration detection sensor 14 detects a lateral-registration position of at least one sheet in the current job is corrected, based on the lateral-registration position detected in the current job.

With this operation, even if the positional accuracy of image with respect to the first sheet deteriorates because the current job is different in condition from the previous job, the positional accuracy of image with respect to the third and the following sheets is improved. The current job is different in condition from the previous job, for example, in a case where even though the size of sheets has not been changed in the feeding trays 7*a* to 7*e*, sheets were replaced with other sheets and the difference in displacement in cutting process between the sheets stored before the replacement and the sheets stored after the replacement is large. In this case, since the difference is large, the lateral-registration position of the sheets stored after the replacement will change significantly from the lateral-registration position of the sheets stored before the replacement.

Figure 7:
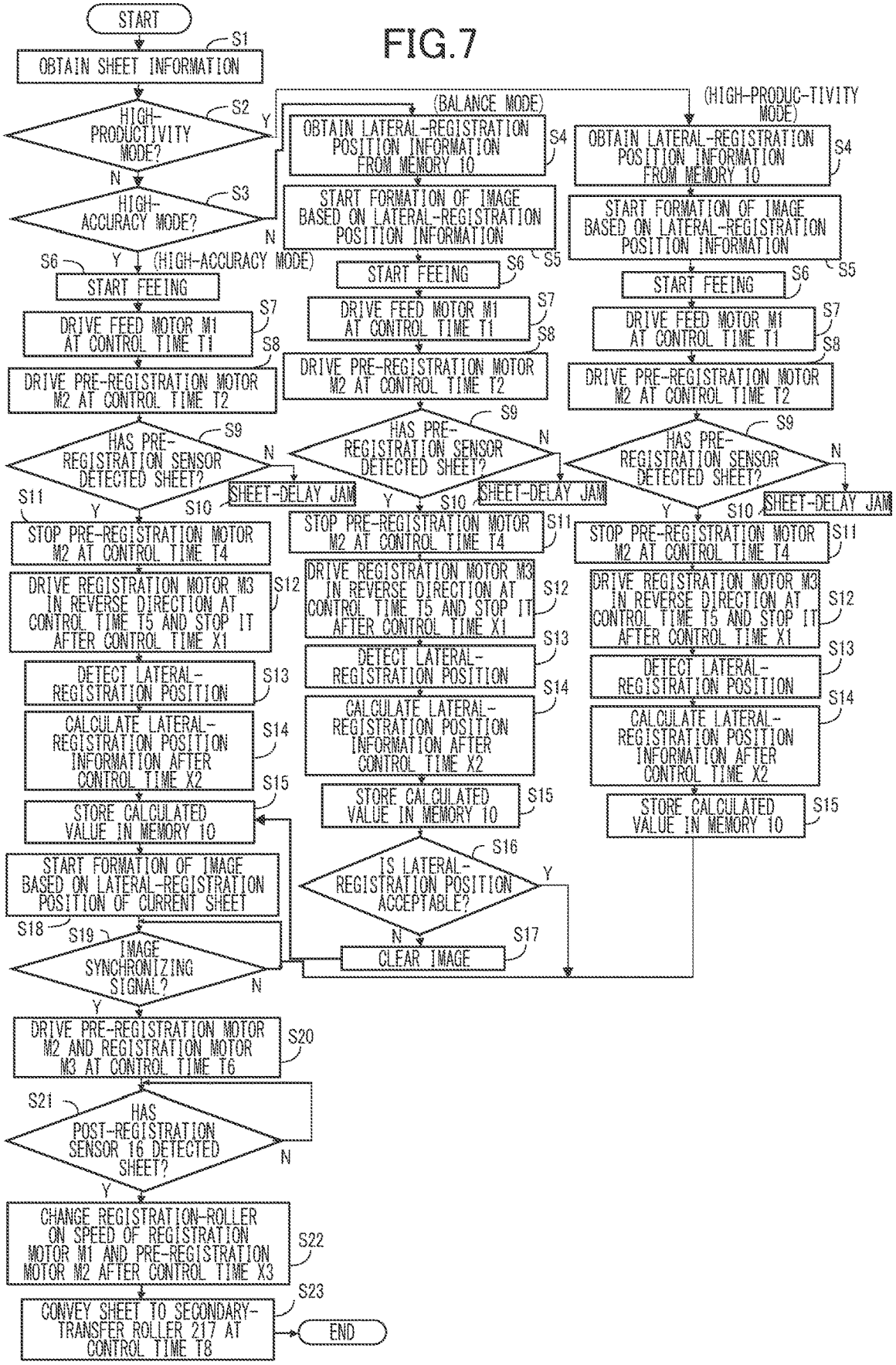
FIG. 7 is a flowchart illustrating a control method of an image forming apparatus of an embodiment.

After the controller 9 causes the image forming portion 201B to start the formation of an image in S5 of FIG. 7, the controller 9 starts the feeding sequence (S6), and starts to feed the sheet P at the control time T1 at the feeding speed V1 by starting the feed motor M1 (S7). The sheet P is abutted against the nip portion of the pre-registration roller 8 that is in a stop state, and the bend (loop) of the sheet P is formed. As a result, simplified skew correction is performed on the sheet P, and variations of the leading-edge position of the sheet P are reduced. Then, the controller 9 causes the pre-registration roller 8 to convey the sheet P at the control time T2, by starting the pre-registration motor M2 (S8).

The leading edge of the sheet P is then detected by the pre-registration sensor 12 at the control time T3 (S9). As a result, the pre-registration roller 8 further conveys the sheet P, after the leading edge of the sheet P abuts against the nip portion of the registration roller 15 that is in a stop state, by the predetermined distance Y3 until the control time T4. At the control time T4, the controller 9 stops the pre-registration motor M2 (S11). With this operation, the bend (loop) of the sheet P is formed between the pre-registration roller 8 and the registration roller 15. If the leading edge of the sheet P has not been detected by the pre-registration sensor 12 even when a predetermined time has elapsed since the step S8, the controller 9 determines that a sheet jam (or delay jam) has occurred (S10).

While the controller 9 causes the pre-registration motor M2 to be in a stop state, the controller 9 rotates the registration motor M3 in a reverse direction in the control time X1, and then stops the registration motor M3 (S12). With this operation, the skew of the sheet P is corrected with higher accuracy. In addition, the controller 9 obtains the lateral-registration position of the sheet P, which is a detection result obtained by the lateral-registration detection sensor 14 (S13). That is, the lateral-registration detection sensor 14, during the predetermined control time X2 in which the registration motor M3 is in a stop state, detects a side-edge position of the sheet P whose skew has been corrected by the reverse rotation of the registration roller 15. The controller 9 calculates the lateral-registration position information that corresponds to sheet information used in the current job, based on the lateral-registration position of the sheet P obtained in S13 (S14).

If the lateral-registration position of the n-th sheet detected by the lateral-registration detection sensor 14 is denoted by Δ(n), the lateral-registration position information is an average value Δav of lateral-registration positions of m sheets (m is a natural number, and is preferably about 10) (see the following equation). Note that if the number of sheets whose lateral-registration positions have been detected by the lateral-registration detection sensor 14 in the current job is smaller than m, the number of sheets whose lateral-registration positions have been detected in the current job is used instead of m. The lateral-registration position Δ(n) is a numerical value that represents what distance the side edge of the sheet P is deviated from a predetermined reference position of the lateral-registration detection sensor 14 in the sheet width direction.

$$\Delta av=(\Delta(n-m)+\Delta(n-m+1)+\ldots+\Delta(n))/m(\text{if } n>m)$$

$$\Delta av=(\Delta(1)+\Delta(2)+\ldots+\Delta(n))/m(\text{if } n\leq m)$$

Then, the controller 9 stores the average value Δav calculated in S14, in the memory 10, as new lateral-registration position information (S15). With this operation, the lateral-registration position information is updated. As described above, an image to be formed on the N-th sheet (N≥3) in the current job is formed, based on the average value Δav of lateral-registration positions Δ(n) of sheets up to (N−2)th sheet of the current job. That is, an image to be formed on one of the third and the following sheets (i.e., the N-th sheet in FIG. 9A) in the high-productivity mode of FIG. 8 is formed, based on the lateral-registration position information Δav(N) calculated by using the following equation in the current job.

$$\Delta av(N)=(\Delta(N-m-2)+\Delta(N-m-1)+\ldots+\Delta(N-2))/m$$

When the next job that has the same sheet information as that of the current job is executed, images to be formed on the first and the second sheets of the next job are formed, based on the lateral-registration position information updated with the average value Δav calculated in the current job.

When a synchronizing signal is issued for positioning the sheet P and an image formed by the image forming portion 201B with respect to each other, in the conveyance direction (S19), the controller 9 starts the conveyance of the sheet P at the control time T6, by starting the registration motor M3 and the pre-registration motor M2 (S20). The leading edge of the sheet P conveyed by the registration roller 15 is detected by the post-registration sensor 16 at the control time T7 (S21). As a result, when the predetermined control time X3 has elapsed since the control time T7, the controller 9 controls the speed of the registration motor M3 and the pre-registration motor M2 for changing the conveyance speed of the sheet P into the process speed V4 (S22). After that, at a timing at which the leading edge of the sheet P reaches the secondary transfer portion (j) at the control time T8, the leading edge of the toner image reaches the secondary transfer portion (j) (S23), and the toner image is transferred onto the sheet P. In a case where images are formed on a plurality of sheets P, the steps S4 to S15 and S19 to S23 are repeated.

Next, the flow of the balance mode will be described. In the balance mode, the steps S4 to S15 are the same as those of the high-productivity mode. In the balance mode, however, the controller 9 determines after the step S15 whether the difference between the lateral-registration position Δ(n) of the sheet P detected by the lateral-registration detection sensor 14 and the lateral-registration position information (obtained in S4) used for forming an image has exceeded the predetermined threshold Δy (S16).

As illustrated in FIG. 8, the lateral-registration position information used for forming an image in the balance mode is the same as that used in the high-productivity mode. That is, the lateral-registration position information used for forming an image to be formed on the first or the second sheet is an average value Δav of lateral-registration positions updated in the previous job, or a lateral-registration position Δ(0) that corresponds to the sheet information of the current job and that was set in advance. FIG. 9B illustrates that the mode of the current job is the balance mode, and that since the sheet information of the previous job matches the sheet information of the current job, the positions of images to be formed on the first and the second sheets of the current job are corrected, based on the average value Δav of lateral-registration positions obtained in the previous job.

The lateral-registration position information used for forming an image to be formed on the n-th sheet (n≥3) of the current job is an average value Δav of lateral-registration positions of sheets up to the (n−2)th sheet of the current job, detected by the lateral-registration detection sensor 14.

If the difference between one of the above-described pieces of lateral-registration position information used for forming an image to be formed on the n-th sheet and the lateral-registration position Δ(n) of the n-th sheet detected by the lateral-registration detection sensor 14 is equal to or smaller than the threshold Δy (S16: N), the controller 9 continues the formation of the image to be formed on the n-th sheet. The operations (S19 to S23) performed in this case are the same as those of the high-productivity mode.

If the difference is larger than the above-described threshold Δy, the controller 9 cancels the formation of images to be formed on the n-th and the (n+1)th sheets. That is, in this case, the controller 9 determines that the lateral-registration position Δ(n) of the n-th sheet detected by the lateral-registration detection sensor 14 does not satisfy a predetermined specification defined for the lateral-registration position information used for forming the image (S16: Y), and clears the images whose formation has already been started (S17). In addition, the lateral-registration position Δ(n) of the n-th sheet detected by the lateral-registration detection sensor 14 is stored in the memory 10, as new lateral-registration position information (S15). Then, the formation of images to be formed on the n-th and the (n+1)th sheets are restarted, based on the new lateral-registration position information (S18). The operations (S19 to S23) performed after this operation are the same as those of the high-productivity mode.

FIG. 9B illustrates an operation performed when the image forming process is retried for the third sheet of the current job. In this case, although the formation of an image to be formed on the third sheet of the current job is started, based on the lateral-registration position of the first sheet, the difference between the lateral-registration position of the third sheet and the lateral-registration position of the first sheet is equal to or larger than the threshold. Thus, the controller 9 cancels the formation of the image to be formed on the third sheet, which has already been started; and starts to form a new image in a state where the position of the image has been corrected based on the lateral-registration position of the third sheet.

As described above, the balance mode uses the same lateral-registration position information as that of the high-productivity mode, as illustrated in FIG. 8. Thus, as long as the difference between the lateral-registration position information used for forming an image and the lateral-registration position of a sheet detected actually by the lateral-registration detection sensor 14 does not exceed the predetermined threshold Δy, the balance mode can achieve the same FPOT and throughput as those achieved by the high-productivity mode. However, if the difference between the lateral-registration position information used for forming an image and the lateral-registration position of a sheet detected actually by the lateral-registration detection sensor 14 has exceeded the predetermined threshold Δy, the controller 9 retries the formation of the image, based on the lateral-registration position of the sheet detected actually by the lateral-registration detection sensor 14 (S16 to S18). In this manner, the balance mode can secure the positional accuracy of image that corresponds to the threshold Δy, for resulting objects, such as direct mails (postcards), POP, and advertisements, that require a certain level of positional accuracy of image.

In other words, the high-productivity mode is a first mode; and in the first mode, in a case where the formation of an image to be formed on the first sheet is started by the image forming portion, before the position of the first sheet is detected by the detection portion, based on the position information updated in the previous job, the formation of the image is continued by the image forming portion, regardless of the difference between the position information used for forming the image to be formed on the first sheet and the position of the first sheet detected by the detection portion. The balance mode is a second mode; and in the second mode, in a case where the formation of an image to be formed on the first sheet is started by the image forming portion, before the position of the first sheet is detected by the detection portion, based on the position information updated in the previous job, if the difference between the position information used for forming the image to be formed on the first sheet and the position of the first sheet detected by the detection portion is larger than a predetermined threshold, the image forming portion cancels the formation of the image, and starts the formation of a new image, based on the position of the first sheet detected by the detection portion. In the present embodiment, since the first mode or the second mode can be selected (that is, can be selectively executed), the image forming apparatus with higher usability can be provided. Note that the sentence "the first mode or the second mode can be selected (that is, can be selectively executed)" means that any one of a plurality of modes (or three or more modes) that includes the two modes can be executed.

Next, the flow of the high-accuracy mode will be described. In the high-accuracy mode, before the controller 9 starts the formation of an image to be formed on the n-th sheet (n≥1), the controller 9 starts to feed the n-th sheet (S6). Then, the controller 9 obtains the lateral-registration position Δ(n) of the n-th sheet detected by the lateral-registration detection sensor 14, and updates the lateral-registration position information (Δav) (S7 to S15), through the same procedure as that of the high-productivity mode. In addition, the controller 9 causes the image forming portion 201B to start the formation of an image to be formed on the n-th sheet, based on the lateral-registration position Δ(n) of the n-th sheet obtained in S13 (S18). The operations (S19 to S23) performed after this operation are the same as those of the high-productivity mode.

Note that in the high-accuracy mode, the lateral-registration position information (Δav), which is an average value of lateral-registration positions Δ(n), is not referred to when an image is formed by the image forming portion 201B. However, if the lateral-registration position information (Δav) is calculated in the high-accuracy mode, the lateral-registration position information (Δav) can be referred to for forming images to be formed on the first and the second sheets in the next job if the next job is performed in the high-productivity mode or the balance mode (see FIGS. 9A and 9B). With this operation, it is possible in the next job to shorten the FPOT while suppressing the deterioration of positional accuracy of image.

In this manner, in the high-accuracy mode, as illustrated in FIGS. 8 and 9C, the controller 9 causes the image forming portion 201B to form an image to be formed on the n-th sheet (that is, on a corresponding sheet), in the current job, based on the lateral-registration position Δ(n) of the n-th sheet detected by the lateral-registration detection sensor 14. Thus, although the FPOT and the throughput deteriorate compared to those of the high-productivity mode, the high-accuracy mode can produce resulting objects with higher positional accuracy of image.

In other words, the high-productivity mode or the balance mode is a third mode; and in the third mode, if the sheet information of sheets used in the previous job matches the sheet information of sheets used in the current job, the image forming portion starts the formation of an image to be formed on the first sheet, before the position of the first sheet is detected by the detection portion, based on the position information updated in the previous job. The high-accuracy mode is a fourth mode; and in the fourth mode, the image forming portion starts the formation of an image to be formed on the first sheet, after the position of the first sheet is detected by the detection portion, based on the position of the sheet detected by the detection portion, regardless of whether the sheet information of sheets used in the previous job matches the sheet information of sheets used in the current job. In the present embodiment, since the third mode or the fourth mode can be selected (that is, can be selectively executed), the image forming apparatus with higher usability can be provided. Note that the sentence "the third mode or the fourth mode can be selected (that is, can be selectively executed)" means that any one of a plurality of modes (or three or more modes) that includes the two modes can be executed.

Modification 1

In the above-described embodiment, if the sheet information of a current job does not match the sheet information of the previous job in the high-productivity mode or the balance mode, the formation of an image to be formed on the first sheet is started in the current job, by using the preset position information (Δ(0)) defined for each item of sheet information. Instead of this, the sheet information that matches the sheet information of the current job may be searched for in the lateral-registration position information (Δav) updated in the job performed before the previous job or in jobs that precede the job performed before the previous job, and the preset position information (Δ(0)) for the sheet information that matches the sheet information of the current job may be used for forming an image to be formed on the first sheet. In this case, the memory 10 may store the lateral-registration position information (Δav), for each item of sheet information, updated in a job that immediately precedes a current job; and when the current job is given, the controller 9 may select lateral-registration position information (Δav) that corresponds to the sheet information of the current job. Even in such a configuration, the same effects as those of the above-described embodiment can be produced.

Modification 2

In another modification, if the sheet information of a current job does not match the sheet information of the previous job in the high-productivity mode or the balance mode, images to be formed on a predetermined number of sheets starting from the first sheet may be formed such that the formation of each of the images is started after the lateral-registration position of the image is detected. In this case, the predetermined number of sheets starting from the first sheet may be processed as in the high-accuracy mode; and for the following sheets, the mode may be switched from the high-accuracy mode to the high-productivity mode or the balance mode. In this configuration, in a case where the sheet information of a current job does not match the sheet information of the previous job, the FPOT becomes longer than that of the above-described embodiment. However, at least in a case where the sheet information of a current job matches the sheet information of the previous job, the FPOT becomes equal to that of the above-described embodiment.

Other Examples

In the above-described embodiment, the mode of each image forming job can be selected from the three modes: the high-productivity mode, the balance mode, and the high-accuracy mode. The present disclosure, however, is not limited to this. For example, any one or two of the three modes may be executed. In addition, a mode different from the three modes may replace one of the three modes, or may be added to the three modes and selected.

In the above-described embodiment, the description has been made as an example for a case where the sheet is mainly fed from the feeding tray 7*a*. The present disclosure, however, is not limited to this. The same control can be performed for sheets fed from the other feeding trays 7*b* to 7*d* of the image forming apparatus 201, or for sheets fed from an apparatus that is connected with the image forming apparatus 201 and that supplies sheets to the image forming apparatus 201 (that is, for sheets fed from the apparatus via the image forming apparatus 201).

In addition, in the above-described embodiment, the description has mainly been made for the color-mode image forming operation that uses the four process cartridges PY to PK. However, the same control can be performed in a monochrome mode that uses only the process cartridge PK of black, for example. Note that when only one of the process cartridges PY, PM, PC, and PK is used in a monochrome mode for forming images, the distance Ly may be replaced with a distance from the exposing position of the photosensitive drum 212 located at the most upstream side in the conveyance direction of the intermediate transfer belt 216, to the secondary transfer portion (j).

In addition, the image forming portion 201B described as an example in the above-described embodiment is one example of the image forming portion. Thus, the image forming portion may be a direct-transfer electrophotographic unit that directly transfers a toner image formed on a photosensitive member onto a sheet, or may be an ink-jet or offset-printing image forming portion.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-143319, filed on Sep. 2, 2021, which is hereby incorporated by reference herein in its entirety.

What is claimed is:

1. An image forming apparatus comprising:

a sheet stacking portion on which a sheet is stacked;

an image forming portion configured to form an image on a sheet fed from the sheet stacking portion;

a detection portion configured to detect a position, in a sheet width direction orthogonal to a sheet conveyance direction, of a sheet being fed from the sheet stacking portion to the image forming portion;

a storage configured to store position information of a sheet in the sheet width direction; and a controller configured to control a job in which a sheet is fed from the sheet stacking portion and the image forming portion forms an image on the sheet, wherein the controller is configured to cause the storage to store the position information based on a position of a sheet detected by the detection portion during execution of the job, and if sheet information of a sheet used in a previous job matches sheet information of a sheet used in a current job, cause the image forming portion to start formation of an image to be formed on a first sheet, before a position of the first sheet is detected by the detection portion, based on the position information stored in the storage in the previous job.

2. The image forming apparatus according to claim 1, wherein the storage is configured to store preset position information preset for each item of sheet information, and wherein if the sheet information of the sheet used in the previous job does not match the sheet information of the sheet used in the current job, the controller is configured to cause the image forming portion to start the formation of the image to be formed on the first sheet, before the position of the first sheet is detected by the detection portion, based on the preset position information corresponding to the sheet information of the sheet used in the current job.

3. The image forming apparatus according to claim 1, wherein in a case where the controller causes the image forming portion to start the formation of the image to be formed on the first sheet, before the position of the first sheet is detected by the detection portion, based on the position information stored in the storage in the previous job, and if a difference between the position information used for forming the image to be formed on the first sheet and the position of the first sheet detected by the detection portion is larger than a predetermined threshold, the controller is configured to cause the image forming portion to cancel the formation of the image and start formation of a new image to be formed on the first sheet, based on the position of the first sheet detected by the detection portion.

4. The image forming apparatus according to claim 3, wherein the controller is configured to cause the image forming portion to start formation of an image to be formed on a second sheet following the first sheet and fed from the sheet stacking portion, before the position of the first sheet is detected by the detection portion, and wherein in a case where the controller causes the image forming portion to start the formation of the image to be formed on the first sheet, before the position of the first sheet is detected by the detection portion, based on the position information stored in the storage in the previous job, and if the difference between the position information used for forming the image to be formed on the first sheet and the position of the first sheet detected by the detection portion is larger than the predetermined threshold, the controller is configured to cause the image forming portion to cancel the formation of the images to be formed on the first and the second sheets and start the formation of new images to be formed on the first and the second sheets, based on the position of the first sheet detected by the detection portion.

5. The image forming apparatus according to claim 1, wherein the controller is configured to selectively execute a first mode or a second mode, wherein in the first mode, in a case where the controller causes the image forming portion to start the formation of the image to be formed on the first sheet, before the position of the first sheet is detected by the detection portion, based on the position information stored in the storage in the previous job, the controller is configured to cause the image forming portion to continue the formation of the image, regardless of a difference between the position information used for forming the image to be formed on the first sheet and the position of the first sheet detected by the detection portion, and wherein in the second mode, in a case where the controller causes the image forming portion to start the formation of an image to be formed on the first sheet, before the position of the first sheet is detected by the detection portion, based on the position information stored in the storage in the previous job, and if the difference between the position information used for forming the image to be formed on the first sheet and the position of the first sheet detected by the detection portion is larger than a predetermined threshold, the controller is configured to cause the image forming portion to cancel the formation of the image and start formation of a new image, based on the position of the first sheet detected by the detection portion.

6. The image forming apparatus according to claim 5, wherein the controller is configured to determine which of the first mode and the second mode the controller is to execute, depending on an instruction from a user.

7. The image forming apparatus according to claim 1, wherein the controller is configured to selectively execute a third mode or a fourth mode, wherein in the third mode, if the sheet information of the sheet used in the previous job matches the sheet information of the sheet used in the current job, the controller is configured to cause the image forming portion to start formation of an image to be formed on a first sheet, before the position of the first sheet is detected by the detection portion, based on the position information stored in the storage in the previous job, and wherein in the fourth mode, the controller is configured to cause the image forming portion to start the formation of an image to be formed on the first sheet, after the position of the first sheet is detected by the detection portion, based on the position of the sheet detected by the detection portion, regardless of whether the sheet information of the sheet used in the previous job matches the sheet information of the sheet used in the current job.

8. The image forming apparatus according to claim 7, wherein the controller is configured to determine which of the third mode and the fourth mode the controller is to execute, depending on an instruction from a user.

9. The image forming apparatus according to claim 1, wherein the sheet information is at least one selected from a group of size, thickness, grammage, and surface property of sheets.

10. The image forming apparatus according to claim 1, wherein the storage is configured to store sheet information of a sheet stacked on the sheet stacking portion, and wherein the controller is configured to determine whether the sheet information of the sheet used in the previous job matches the sheet information of the sheet used in the current job, based on the sheet information stored in the storage.

11. The image forming apparatus according to claim 1, further comprising a plurality of sheet stacking portions including the sheet stacking portion, wherein if a sheet stacking portion among the plurality of sheet stacking portions that serves as a sheet feeding source in the previous job is different from a sheet stacking portion among the plurality of sheet stacking portions that serves as a sheet feeding source in the current job, the controller is configured to determine that the sheet information of the sheet used in the previous job does not match the sheet information of the sheet used in the current job.

12. The image forming apparatus according to claim 1, wherein the controller is configured to update the position information to be stored in the storage, with an average value of positions of a plurality of sheets detected by the detection portion during execution of a job.

13. The image forming apparatus according to claim 1, wherein the image forming portion includes at least one photosensitive member, an exposing unit configured to form an electrostatic latent image by exposing the photosensitive member, a developing unit configured to develop the electrostatic latent image formed on the photosensitive member, into a toner image by using developer, and a transfer unit configured to transfer the toner image onto a sheet, and wherein if the sheet information of the sheet used in the previous job matches the sheet information of the sheet used in the current job, the controller is configured to cause the exposing unit to start formation of an electrostatic latent image corresponding to the image to be formed on the first sheet, before the position of the first sheet is detected by the detection portion, with a starting position of the exposing unit to start forming the electrostatic latent image in a main scanning direction of the photosensitive member corrected based on the position information stored in the storage in the previous job.

* * * * *